US009494107B2

(12) United States Patent
Whittaker et al.

(10) Patent No.: US 9,494,107 B2
(45) Date of Patent: Nov. 15, 2016

(54) THERMODYNAMIC MACHINE

(71) Applicant: Whittaker Engineering (Stonehaven) Limited, Aberdeen (GB)

(72) Inventors: Kenneth Whittaker, Aberdeenshire (GB); Keith Graham Watt, Aberdeenshire (GB)

(73) Assignee: Foster Findlay Associates Limited (GB)

( * ) Notice: Subject to any disclaimer, the term of this patent is extended or adjusted under 35 U.S.C. 154(b) by 0 days.

(21) Appl. No.: 14/772,490

(22) PCT Filed: Mar. 7, 2014

(86) PCT No.: PCT/GB2014/050683
§ 371 (c)(1),
(2) Date: Sep. 3, 2015

(87) PCT Pub. No.: WO2014/135895
PCT Pub. Date: Sep. 12, 2014

(65) Prior Publication Data

US 2016/0017843 A1 Jan. 21, 2016

(30) Foreign Application Priority Data

Mar. 8, 2013 (GB) ..... 1304243.7

(51) Int. Cl.
*F02G 1/05* (2006.01)
*F02G 1/055* (2006.01)
(Continued)

(52) U.S. Cl.
CPC ..... *F02G 1/05* (2013.01); *F02G 1/043* (2013.01); *F02G 1/044* (2013.01); *F02G 1/055* (2013.01);
(Continued)

(58) Field of Classification Search
CPC ..... F02G 1/05; F02G 1/055; F02G 1/057; F02G 1/044; F02G 1/043; F02G
(Continued)

(56) References Cited

U.S. PATENT DOCUMENTS 2,724,248 A 11/1955 Finkelstein
3,457,722 A * 7/1969 Bush ..... F02G 1/043 60/522
(Continued)

FOREIGN PATENT DOCUMENTS

| | | |
|---|---|---|
| DE | 19851721 | 5/2000 |
| DE | 202008001920 | 4/2008 |
| GB | 2396887 | 7/2004 |

OTHER PUBLICATIONS

Notification of Grant, U.K. Application No. GB2513241, mailed Aug. 25, 2015 (2 pages).
(Continued)

*Primary Examiner* — Hoang Nguyen
(74) *Attorney, Agent, or Firm* — Workman Nydegger

(57) ABSTRACT

A thermodynamic machine (1) of a Stirling type, the machine comprising an expansion chamber (5), a compression chamber (6), a regenerator (12) disposed between the expansion and compression chambers; a first heat exchanger (13) in communication with the expansion chamber and the regenerator; a second heat exchanger (14) in communication with the compression chamber and the regenerator; a first bypass conduit (15) connecting the expansion chamber with the regenerator bypassing the first heat exchanger; a second bypass conduit (16) connecting the compression chamber with the regenerator bypassing the second heat exchanger; at least a pair valves (18, 20, 22, 24), one valve (18, 20) provided between the expansion chamber and the first heat exchanger and/or between the regenerator and the first heat exchanger and/or in the first bypass conduit between the
(Continued)

Figure 1A:
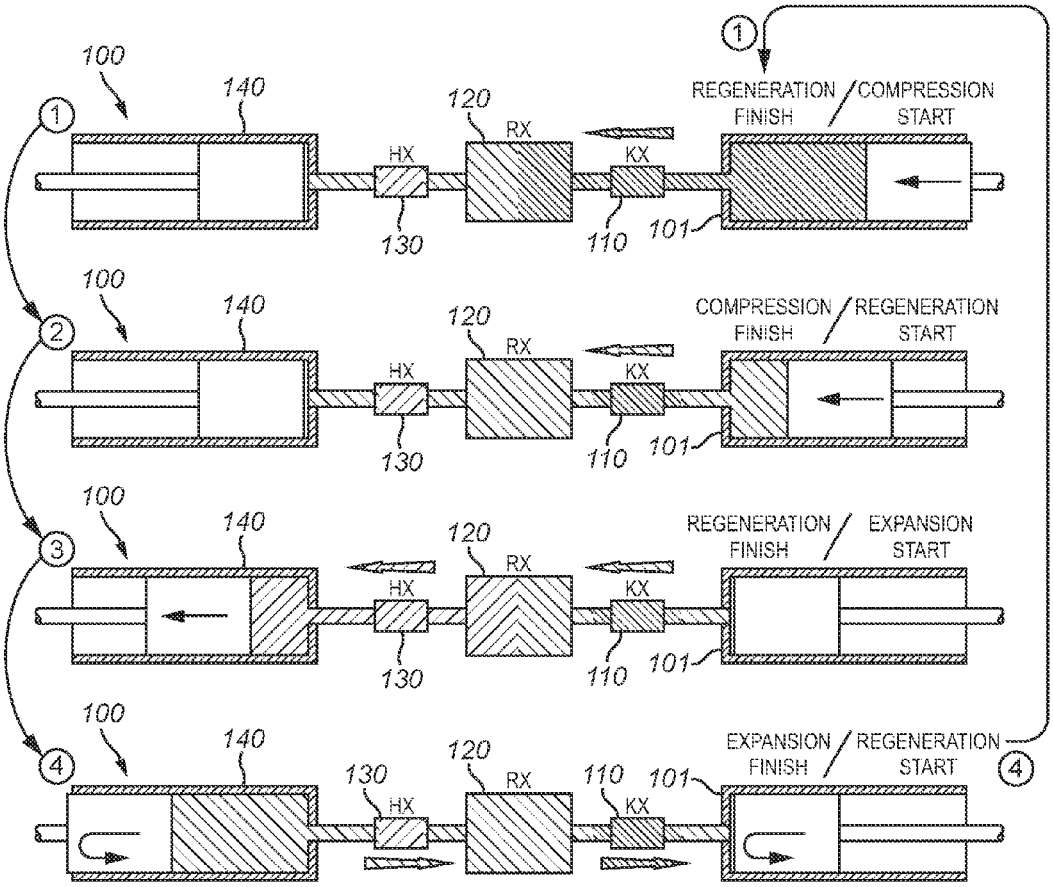

expansion chamber and the regenerator; and the other valve (22, 24) provided between the compression chamber and the second heat exchanger and/or between the regenerator and the second heat exchanger and/or in the second bypass conduit between the compression chamber and the regenerator; the valves being controllable.

50 Claims, 12 Drawing Sheets

(51) Int. Cl.
*F02G 1/043* (2006.01)
*F02G 1/044* (2006.01)
*F02G 1/057* (2006.01)

(52) U.S. Cl.
CPC ..... *F02G 1/057* (2013.01); *F02G 2243/30* (2013.01); *F02G 2243/32* (2013.01); *F02G 2243/34* (2013.01)

(58) Field of Classification Search
CPC ..... 2243/34;F02G 2243/30; F02G 2243/32
USPC ..... 60/517–526
See application file for complete search history.

(56) References Cited

U.S. PATENT DOCUMENTS 5,720,172 A 2/1998 Ishizaki
2010/0186405 A1 7/2010 Conde

OTHER PUBLICATIONS

Combined Search and Examination Report, U.K. Application No. GB1304243.7, mailed Jan. 15, 2014 (6 pages).
Combined Search and Examination Report, U.K. Application No. GB1404062.0, mailed Mar. 27, 2014 (2 pages).
Examination Report, U.K. Application No. GB1404062.0, mailed Apr. 30, 2015 (2 pages).
International Search Report and Written Opinion from International Application No. PCT/GB2014/050683, mailed Sep. 12, 2014 (8 pages).

* cited by examiner

THERMODYNAMIC MACHINE

FIELD OF THE INVENTION

The invention relates to a thermodynamic machine.

BACKGROUND TO THE INVENTION

Energy converters utilising the Stirling Cycle (typically called "Stirling engines") are well known and come in various configurations. A typical so called "alpha" type Stirling engine has two pistons reciprocating within respective cylinders. The cylinders are connected by a tube accommodating a special heat exchanger known as a regenerator. The pistons are both connected to a flywheel and a crankshaft. A working fluid of constant mass, typically gas, is hermetically contained within the cylinders and the tube. One cylinder, also known as a hot cylinder or an expansion cylinder, is connected with a heater to heat the fluid in that cylinder and the other cylinder, also known as a cold cylinder or compression cylinder is connected with a cooler to take heat away from that cylinder. The working fluid is cycled back and forth between the expansion cylinder and the compression cylinder, and passes through the regenerator twice in each cycle, while the regenerator alternately absorbs heat from, and releases heat to, the working fluid. The addition of heat to the expansion cylinder and the extraction of heat in the compression cylinder cause a series of compressions and expansions of the working fluid in the chambers, thereby causing the pistons in the chambers to reciprocate and to drive the crankshaft, which can provide work output in the form of rotational power. The regenerator retains a portion of the heat received in the expansion cylinder as the heated fluid passes from the expansion cylinder to the compression cylinder and gives the stored heat away as the fluid cooled in the compression cylinder flows in the opposite direction. The regenerator recycles heat which otherwise would be lost at the cold cylinder and thus increases thermal efficiency of a Stirling engine compared to other hot air engines. This part of the Stirling cycle is known as "regeneration". Other types of a Stirling engine include so called "beta" and "gamma" types, which differ from the "alpha" type structurally, but operate under the same principle. A detailed discussion of the functioning of conventional Stirling engines is set forth in the book "Stirling Engines" by Graham Walker, Clarendon Press, 1980, the disclosure of which is incorporated herein by reference.

An attractive aspect of a Stirling engine nowadays is that it can be powered by practically any source of heat, including renewable energy sources such as sun and heat energy generated by wind. At the same time, a Stirling engine has several further advantageous features including that it produces virtually no atmospheric emissions and works with minimal noise.

Despite its apparent advantages, the efficiency of the Stirling engine is compromised by the series arrangement of the cooler, regenerator and heater. An ideal Stirling cycle assumes that the expansion and compression phases of the cycles occur isothermally. In reality this is unlikely to be the case since it is virtually impossible to provide a constant external inflow or outflow of heat conforming to the speed of piston strokes in order to maintain the same temperature during expansion or compression. Thus, it is often assumed that the expansion and compression phases occur adiabatically, i.e. the working fluid is heated upon compression and cooled upon expansion. A cycle occurring under this assumption is referred to as an ideal pseudo-Stirling cycle.

In an ideal pseudo-Stirling cycle, after the fluid is heated by compression, it is cooled by the cooler at the compression cylinder, and then is heated again in the regenerator. Similarly the working fluid is re-heated by the heater after the working fluid has cooled during expansion in the expansion cylinder during a power stroke, and cooled again in the regenerator. This is counterproductive. An attempt to mitigate this drawback is disclosed in U.S. Pat. No. 2,724,248 to T. Finkelstein et al which describes a Stirling cycle machine incorporating one way "simple flap" valves.

A further attempt to mitigate this drawback is described in a thesis entitled "A Computer Simulation of Stirling Cycle Machines", I. Urieli, Johannesburg, February 1977 submitted to the Faculty of Engineering University of the Witwatersrand, Johannesburg. This thesis publication describes one-way passive valves (and specifically discloses "simple flap valves") respectively connecting each of the compression cylinder and the expansion cylinder directly with the regenerator to avoid unnecessarily cooling the compressed fluid and heating the expanded fluid on its way respectively from the compression and expansion cylinders to the regenerator. However, in this arrangement, when the bypass valve is open, the fluid can pass simultaneously through the bypass valve and the respective heater or cooler thus still resulting in a waste of energy.

The inventors have appreciated the need to further improve the efficiency of the above-described bypass arrangement.

Further attempts have been made to devise alternative machines to a Stirling cycle engine such as the alternative machine disclosed in US Patent publication number 2010/0186405 to Conde (assigned to Regen Power Systems LLS) and which discloses a closed cycle heat engine but which differs to a Stirling cycle machine because it has a working fluid flow path for the heated air which is separate from the working fluid flow path for the cooled air, the two working fluid flow paths remaining separated in a regenerator in the specific form of a twin path or counter-flow recuperator. Furthermore, US Patent publication number 2010/0186405 to Conde discloses an unbalanced system in which there are a greater number of expansion chambers than compression chambers which results in a greater working volume of the expansion chambers compared with the compression chamber.

Additionally, U.S. Pat. No. 5,720,172 discloses a flow controller for a Stirling cycle type engine, the flow controller having a pair of plate spring type valve plates which in practice act as simple one way valves and therefore provide a flow path controller, and a cock or throttle interposed in the said flow path which is used to control the flow rate along the flow path but only when fluid is able to flow along the flow path in the direction permitted by the plate spring type valve plate.

Accordingly, the object of the present invention is to provide a heat machine of a Stirling type having greater efficiency compared with prior art machines.

SUMMARY OF THE INVENTION

According to a first aspect of the invention there is provided a thermodynamic machine of a Stirling cycle type, the machine being operable as a heat engine and/or heat pump, the machine comprising:

an expansion cylinder defining an expansion chamber, a compression cylinder defining a compression chamber and respective pistons reciprocally movable in the cylinders during operation of the machine;

a regenerator disposed between and in communication with the expansion and compression chambers;

a first heat exchanger in communication with the expansion chamber and the regenerator and a second heat exchanger in communication with the compression chamber and the regenerator;

a first bypass conduit connecting the expansion chamber with the regenerator bypassing the first heat exchanger and a second bypass conduit connecting the compression chamber with the regenerator bypassing the second heat exchanger; wherein the machine comprises at least a pair of valves one valve being provided between the expansion chamber and the first heat exchanger or between the regenerator and the first heat exchanger or in the first bypass conduit between the expansion chamber and the regenerator;

and the other valve being provided between the compression chamber and the second heat exchanger or between the regenerator and the second heat exchanger or in the second bypass conduit between the compression chamber and the regenerator; and wherein at least one of the pair of valves is controllable.

Preferably, the regenerator comprises a regenerator chamber and wherein the thermodynamic machine is arranged such that substantially the whole volume of a working fluid will pass through said regenerator chamber twice during a single cycle of the thermodynamic machine.

Preferably, the machine comprises a balanced system in which the number of expansion chamber(s) equals the number of compression chamber(s) and more preferably, the machine comprises a balanced system in which the working volume of the expansion chamber(s) substantially equals the working volume of the compression chamber(s).

Preferably, at least one of the pair of valves is capable of being controllable at least once during each cycle of the thermodynamic machine.

Preferably, the machine further comprises a control mechanism configured to time the opening and closing and any position there-between of the valves.

Preferably, both valves are controllable. More preferably, the control mechanism is adapted to control flow through the valves over time so as to direct working fluid of the machine between the regenerator and the expansion and compression chambers either substantially through the respective bypass conduit or substantially through the respective heat exchanger at pre-determined stages of the machine cycle.

The Stirling cycle type machine preferably comprises a heat engine operating by cyclic compression and expansion of a working fluid such as air or other gas at different temperature levels such that there is a:— net conversion of heat energy to mechanical work when operating in an engine mode; and a net conversion of mechanical work to heat energy when operating in a heat pump mode.

The Stirling cycle type machine further preferably comprises a closed-cycle regenerative heat engine with a permanently gaseous working fluid. The closed cycle typically comprises the working fluid being permanently contained within the machine and more preferably, the volume of working fluid commingles as one single volume (which is a variable volume depending upon the stage of the machine through its cycle) and is not split into two or more separate volumes having separate circuits of flow of working fluid which cannot commingle.

Typically, the said at least one controllable valve is capable of being infinitely adjusted such that it can be controlled between any and all of the following configurations:— i) fully closed such that no working fluid can pass there-through;

ii) fully open such that working fluid can pass there-through substantially without restriction; and iii) any position between fully open and fully closed such that the valve comprises an aperture having an area through which working fluid is capable of flowing;

and wherein the area of the aperture and/or the phasing and/or timing of the movement between the positions i), ii) and/or iii) is infinitely adjustable between the fully open and fully closed positions.

Typically, the said at least one controllable valve is capable of being infinitely adjusted at any point in time in terms of phasing within the cycle of the thermodynamic machine and/or in terms of the stages of operation of the thermodynamic machine.

Typically, the said at least one controllable valve is capable of being infinitely adjusted at any point in time in terms of the duration of time in which the valve will remain in any one of configurations i), ii) or iii).

The regenerator chamber preferably comprises a single chamber such that substantially the whole volume of a working fluid will pass through said single regenerator chamber twice during a single cycle of the thermodynamic machine. The regenerator chamber more preferably comprises a single chamber such that substantially the whole volume of a working fluid will pass through said single regenerator chamber once in a first direction and once in a second, reverse, direction during a single cycle of the thermodynamic machine. Alternatively, the regenerator chamber may comprise two or more chambers connected in series or in parallel such that substantially the whole volume of a working fluid will pass through said two or more regenerator chambers twice during a single cycle of the thermodynamic machine.

The regenerator chamber typically comprises a thermal storage medium and the said chamber is adapted to intermittently store heat from a relatively hot working fluid in said thermal storage medium as the relatively hot working fluid contacts said thermal storage medium as it passes through said regenerator chamber in a first direction. Typically, the regenerator chamber the said chamber is further adapted to intermittently transfer heat from the said thermal storage medium to a relatively cold working fluid as the relatively cold working fluid contacts said thermal storage medium as it passes through said regenerator chamber in a second, reverse, direction.

Typically, in a Stirling machine, the first heat exchanger functions as a heater, i.e. it is configured to transfer heat from surroundings of the heater external to the machine to the working fluid in the expansion chamber, whereas the second heat exchanger functions as a cooler, i.e. it is configured to transfer heat from the working fluid in the compression chamber to surroundings of the cooler external to the machine. Further typically, the pistons of the cylinders are connected to a common output-input member, typically a rotary member, such as for example a flywheel/crankshaft assembly.

Preferably, the valves are actively actuated valves, i.e. of the type which require an external force to be applied to open or close the valves, rather than being passive, i.e. being actuated by the energy of the working fluid of the machine. The valves may be actuated by various suitable external actuators including a direct mechanical drive, electromechanical or electrohydraulic system. The valves may be of any suitable actively actuated valve, including but not limited thereto, rotary, poppet, sleeve and/or disc valves.

Preferably, the control mechanism is adapted to adjust in real time the timing of the valves in accordance with actual operating conditions, thereby further optimising machine efficiency and power output. Preferably, the control mechanism comprises an electronic control module, preferably, including an electronic microprocessor, preferably, a programmable electronic microprocessor.

Typical textbook descriptions of the Stirling cycle are based on highly idealised conditions which bear little resemblance to real operation of a Stirling engine. In particular the expansion and compression processes are assumed to occur isothermally, a situation highly unlikely to exist in practice due to the thickness of walls of the expansion and compression cylinders and the limited time available for heat transfer between the cylinders and the heat exchangers at realistic engine speeds. For practical purposes it is more appropriate to assume the following:

1. The compression and expansion cylinders are adiabatic, i.e. no heat transfer occurs between the cylinders and respective heat exchangers. As a result, the temperature of the working fluid in the compression and expansion cylinders varies with time during piston strokes, i.e. rises during compression and drops during expansion.
2. Constant temperature heat exchangers are provided adjacent to the compression and expansion cylinders.
3. The regenerator is imperfect, i.e. it releases less heat than it absorbs. If the regenerator is working under ideal conditions, the outlet temperature of "hot blow", i.e. heat absorption by the regenerator, would be at the inlet temperature of "cold blow", i.e. release of the stored heat by the regenerator. The regenerator, due to design and material constraints, cannot absorb the total heat from constant volume transfer process, from high to low temperature, and therefore cannot provide the total heat necessary for subsequent constant volume transfer process, from low to high temperature.
4. Piston strokes remain assumed to be highly idealised in order to simplify the cycle description.

The cycle occurring under the assumed conditions described above is often referred to as an ideal pseudo-Stirling cycle.

Preferably, the machine is operable in one or each of a heat engine mode, in which thermal input is converted into mechanical work or a heat pump mode, in which mechanical work is converted into thermal output. Preferably, in the heat pump mode, the machine is operable to provide a positive thermal output, i.e. the machine operates as a heater, or a negative thermal output, i.e. the machine operates as a cooler or refrigerator.

Preferably, the control mechanism is configured to time the valves accordingly in the or each of the heat engine mode and the heat pump mode. Valve timing in the heat engine mode may differ from valve timing in the heat pump mode. The control mechanism may be configured to adjust the timing of the valves, depending on which mode the machine is operating in.

In one arrangement, one valve is provided between the expansion chamber and the regenerator at the first heat exchanger and the other valve is provided between the compression chamber and the regenerator at the second heat exchanger.

Preferably, in the heat engine mode, the control mechanism is configured to control the valves so that during a compression stroke of the piston in the compression cylinder the valve at the second heat exchanger is substantially closed whereby the working fluid is directed to the regenerator substantially through the second bypass conduit substantially bypassing the second heat exchanger. Further preferably, in the heat engine mode, the control mechanism is configured to time the valves so that during a backward stroke of the piston in the expansion cylinder (i.e. when the piston is moving back after an expansion stroke), the valve at the first heat exchanger is substantially closed whereby the working fluid is directed to the regenerator substantially through the first bypass conduit substantially bypassing the first heat exchanger.

Preferably, in the heat pump mode (whether the machine is operating as a heater or as a refrigerator), the control mechanism is configured to control the valves so that during a compression stroke of the piston in the compression cylinder, the valve at the second heat exchanger is substantially open whereas, preferably, the valve at the first heat exchanger is substantially closed, whereby the working fluid is directed to the regenerator through the second heat exchanger thereby rejecting heat gained during compression via the second heat exchanger. Further preferably, in the heat pump mode, the control mechanism is configured to time the valves so that during an expansion stroke of the piston in the expansion cylinder, the valve at the first heat exchanger is substantially open whereas, preferably, the valve at the second heat exchanger is substantially closed, whereby heat is transferred form surroundings of the first heat exchanger into the expansion chamber.

In a preferred embodiment of the invention the machine comprises four valves wherein

- a first valve is provided between the expansion chamber and the first heat exchanger or between the first heat exchanger and the regenerator and a second valve is provided in the first bypass conduit between the expansion chamber and the regenerator;
- a third valve is provided between the compression chamber and the second heat exchanger or between the second heat exchanger and the regenerator and a fourth valve is provided in the second bypass conduit between the compression chamber and the regenerator; and
- wherein at least one of the first, second, third and fourth valves is controllable.

Preferably, all the four valves are controllable.

Advantages of the present invention over prior art Stirling cycle type engines reside in the use of actively actuated valves which provide for a more efficient and/or controllable actuation. Due to the provision of the controllable valves, the same machine in accordance with the invention can be used as a heat engine or as a heat pump because the timing of the valves can be readily reconfigured between the heat engine mode and the heat pump mode as the stages at which the valves need to open or close in the heat engine mode differ from those in the heat pump mode. In contrast, the valves of the prior art machines are passive, i.e. actuated by the flow of the working fluid. For example, a passive valve used in prior art machines is always closed when the working fluid flows in one direction and always open when the working fluid flows in the opposite direction.

Preferably, in the heat engine mode, the control mechanism is configured to time valves so that during a compression stroke of the piston in the compression cylinder the third valve is substantially closed whereas the fourth valve is substantially open whereby the working fluid is directed to the regenerator substantially through the second bypass conduit substantially bypassing the second heat exchanger, i.e. the cooler. Since the compression is assumed to be adiabatic, the working fluid becomes heated during compression. In the regenerator, the working fluid becomes further heated using heat recovered in the previous cycle. Due to the bypass arrangement, in contrast with prior art, the heat of the working fluid obtained during compression is not wasted by cooling the working fluid in the cooler and re-heating again the regenerator. Preferably, at the same time, the first valve is substantially open and the second valve is substantially closed, whereby upon exiting the regenerator, the working fluid is directed to the expansion chamber substantially through the first heat exchanger, i.e. the heater, substantially bypassing the first bypass conduit. As the working fluid passes through the first heat exchanger it is heated still further to provide the working fluid with sufficient energy to effect an expansion stroke in the expansion cylinder. In the expansion chamber, the heated working fluid expands causing the piston to move out in the expansion stroke thus producing useful mechanical work. During the expansion stroke, the working fluid expands and cools adiabatically as its energy becomes converted into mechanical work.

Following expansion in the expansion cylinder, the working fluid is moved towards the regenerator during a backward stroke of the piston which is driven by momentum of the output-input member (e.g. flywheel/crankshaft assembly). Accordingly, further preferably, in the heat engine mode, the control mechanism is configured to time the valves so that during the backward stroke of the piston in the expansion cylinder, the first valve is substantially closed whereas the second valve is substantially open, whereby the working fluid is directed to the regenerator substantially through the first bypass conduit substantially bypassing the first heat exchanger. In the regenerator, the heat of the working fluid is retained and stored for use in the next cycle. Due to the bypass arrangement, the heat supplied by the first heat exchanger, i.e. the heater, is not spent on unnecessarily overheating the working fluid. This additional heat would otherwise be lost, as is the case with prior art engines, because the capacity of the regenerator to extract heat is limited and the additional heat not absorbed by the regenerator and not dissipated through the second heat exchanger would be retained by the working fluid and, as a result, additional work would be required to compress the working fluid in the compression cylinder. Preferably, at the same time, the third valve is substantially open and the fourth valve is substantially closed, whereby upon exiting the regenerator, the working fluid is directed to the compression chamber substantially through the second heat exchanger, i.e. the cooler, substantially bypassing the second bypass conduit. As the working fluid passes through the second heat exchanger, the working fluid is further cooled such that the working fluid still has enough energy to move the piston in the compression cylinder but is cooled sufficiently to reduce the work required to subsequently compress the working fluid in the compression cylinder. In the compression chamber, the working fluid causes the piston to move out in an expansion stroke. During the expansion stroke in the compression cylinder, the working fluid further cools as its energy becomes converted into mechanical work. After the expansion stroke, the cycle begins again.

The provision of a valve at each heat exchanger and each bypass conduit and the specific timing of the valves result in better isolation of the working fluid from the heat exchangers when it is necessary to bypass the heat exchangers, and, similarly, preventing the working fluid from bypassing the heat exchangers when it is necessary for the working fluid to pass through the heat exchangers. Furthermore, such an arrangement of the valves causes the working fluid to circulate, rather than oscillate back and forth in the machine. The continuous, rather than oscillating, flow of working fluid through the heat exchangers simplifies and optimises the behaviour of the working fluid. In particular, the potential for parts of the working fluid to become 'trapped' in the heat exchangers and the regenerator due to rapid flow reversal is almost eliminated.

In order for the machine to operate in the heat pump mode (whether as a heater or as a refrigerator), the output-input member (e.g. the flywheel/crank shaft assembly) must be driven externally to provide mechanical work to drive the pistons of the cylinders to compress or expand the working fluid and as a result to obtain thermal output. Accordingly, in the heat pump mode, net work done over the machine cycle is negative. In the heat pump mode, the first heat exchanger, i.e. the heater, and the second heat exchanger, i.e. the cooler, still transfer heat in the same direction, as in the heat engine mode, i.e. the first heat exchanger conducts heat from its surroundings into the expansion cylinder and the second heat exchanger extracts the heat from the compression cylinder and dissipates it into the surroundings of the second heat exchanger. However, in contrast with the heat engine mode, the heat supplied from the surroundings of the first heat exchanger is at lower temperature than the heat rejected by the second heat exchanger into the space surrounding the second heat exchanger. Due to the mechanical input, the temperature of the working fluid during expansion in the expansion cylinder is lowered below the temperature of the space around the first heat exchanger so that the first heat exchanger starts to draw heat from the space surrounding the first heat exchanger. Also, due to the mechanical input the temperature of the working fluid during compression in the compression cylinder is raised above the temperature of the space around the second heat exchanger, so that the second heat exchanger starts to eject heat into the surrounding space. In both the heater mode and the refrigerator mode, heat from the space around the first heat exchanger is drawn via the first heat exchanger into the expansion chamber, whilst heat produced in the compression chamber is rejected from the compression chamber via the second heat exchanger. The difference is mainly in the temperatures and pressures of the working fluid during expansion, compression and regeneration and that in the refrigerator mode, the space surrounding the first heat exchanger is the space to be cooled, and the space around the second heat exchanger is where waste heat produced during the cycle is disposed of, whereas in the heater mode, the space around the first heat exchanger is used as a source of heat and the space around the second heat exchanger is the space which is to be heated by the heat ejected by the second heat exchanger.

Preferably, in the heat pump mode of the machine (whether the machine is operating as a heater or as a refrigerator), the control mechanism is configured to time the valves so that during a compression stroke of the piston in the compression cylinder the third valve is substantially open whereas the fourth valve is substantially closed whereby the working fluid is directed to the regenerator substantially through the second heat exchanger, i.e. the cooler, substantially bypassing the second bypass conduit. Preferably, the compression begins with the working fluid being at ambient temperature. Since the compression is assumed to be adiabatic, the working fluid becomes heated during compression above the ambient temperature and the extra heat is dissipated into the space to be heated through the second heat exchanger. In the regenerator, more heat is extracted from the working fluid and is stored in the regenerator for use later in the cycle. Preferably, at the same time, the first valve is substantially closed and the second valve is substantially open, whereby upon exiting the regenerator, the working fluid is directed to the expansion chamber substantially through the first bypass conduit substantially bypassing the first heat exchanger.

Further preferably, in the heat pump mode of the machine (whether the machine is operating as a heater or as a refrigerator), the control mechanism is configured to time the valves so that during the expansion stroke in the expansion cylinder, the first valve is substantially open whereas the second valve is substantially closed, whereby the working fluid is directed to the expansion cylinder from the regenerator substantially through the first heat exchanger, i.e. the heater, substantially bypassing the first bypass conduit. As the pressure drops during the expansion stroke, the working fluid which has already cooled in the regenerator is cooled still further and since the temperature in the expansion chamber becomes lower than that of the external space around the heater, heat from the external space is drawn through the heater to the working fluid. Preferably, at the same time, the third valve is substantially closed and the fourth valve is substantially open.

Further preferably, in the heat pump mode of the machine (whether operating as a heater or as a refrigerator), the control mechanism is configured to time the valves so that during a backward stroke of the piston in the expansion cylinder the first valve remains substantially open whereas the second valve remains substantially closed, whereby the working fluid is directed to the regenerator substantially through the first heat exchanger substantially bypassing the first bypass conduit. In the regenerator, the working fluid is heated using the heat retained during the previous pass. Preferably, at the same time, the third valve remains substantially closed and the fourth valve remains substantially open whereby upon exiting the regenerator, the working fluid is directed to the compression chamber substantially through the second bypass conduit substantially bypassing the second heat exchanger, whereby an outward stroke in the compression cylinder begins at elevated temperature so as to obtain the required level of heat during the subsequent compression for subsequent ejection through the second heat exchanger. During the outward stroke in the compression cylinder, the working fluid continues to receive heat from the regenerator. Following the outward stroke, the cycle begins again, i.e. the working fluid becomes compressed and heated in the compression cylinder above ambient temperature and the extra heat is dissipated through the second heat exchanger (the cooler).

The timing of the valves may be the same or may be reconfigured between the heater mode and in the refrigerator mode. Further preferably, when the machine is operated in the refrigerator mode, the compression process begins with the working fluid being at ambient temperature. When the machine is operated in the heater mode, the expansion process begins at room temperature so that heat is rejected into the space around the compression cylinder at elevated temperature.

Although, the invention has been described in application to an "alpha" type Stirling machine whether working as an engine or heat pump, it will be appreciated by persons skilled in the art that the invention is readily applicable, with appropriate changes readily apparent to the skilled person, to any thermal machine of a Stirling cycle type, including but not limited to "beta" and "gamma" types. In his regard it should be noted that references above to the expansion and compression cylinders include a reference to a single cylinder, such as that of a beta-Stirling machine, having a section in which a first heat exchanger (a heater) is disposed and a section in which (a second heat exchanger (a cooler) is disposed. It should be noted, however, that the present invention can equally be implemented in any thermodynamic machine of a Stirling type, including, but not limited to "alpha", "beta" or "gamma" configuration. Additionally, multiple thermodynamic machines of a Stirling type, including combinations of different configurations of thermodynamic machines, may be combined to form a thermodynamic machine of the present invention. Furthermore, the thermodynamic machine of the present invention can include multiple expansion and compression chambers.

The thermodynamic machine, with the advantage of the controllable valves within the working fluid circuit, may be scaled to achieve the required magnitude of power output in several ways including:

a) multiple "alpha", "beta" or "gamma" type arrangements within one or more machines, possessing multiple discrete working fluid circuits that are not necessarily interconnected, and b) multiple expansion and compression spaces within each working fluid circuit. The thermodynamic machine of the present invention may have one or a number of working fluid circuits and have power produced by one or more thermodynamic cycles.

The or each of the first and second heat exchangers may be provided in the form of shell and tube exchangers, but the invention is not limited to such a configuration of the heat exchangers. If the second heat exchanger (the cooler) is provided in the form of a shell-and-tube exchanger, cooler tubes are preferably disposed in direct contact with a cooling medium of the second heat exchanger.

In one embodiment, a heat storage device is provided for supplying heat to the first heat exchanger for further transfer into the expansion chamber.

The working fluid is preferably gas or a mixture of gases, preferably a noble gas, e.g. helium. The gas may also comprise air.

In one modification, additional valves may be provided between the regenerator and one or each of the expansion and compression chambers. More than one valve may be provided along each of the four working fluid paths, these being a) between the regenerator and the expansion chamber through the first heat exchanger, b) between the expansion chamber and the regenerator via the first bypass conduit, c) between the regenerator and the compression chamber through the second heat exchanger and d) between the compression chamber and the regenerator via the second bypass conduit. The additional valves are preferably controllable. For example, a first valve can be provided between the expansion chamber and the first heat exchanger and an additional valve can be provided between the first heat exchanger and the regenerator or vice versa. Additionally, or alternatively, a second valve can provided in the first bypass conduit between the expansion chamber and the regenerator and an additional valve can be provided nearer a regenerator end of the first bypass conduit or vice versa. Additionally or alternatively, a third valve can be provided between the compression chamber and the second heat exchanger and an additional valve can be provided between the second heat exchanger and the regenerator or vice versa. Additionally or alternatively, a fourth valve can provided in the second bypass conduit between the compression chamber and the regenerator and an additional valve can be provided nearer a regenerator end of the second bypass conduit or vice versa.

The additional valves are preferably timed to open or close in coordination with the main valves, preferably, so as to capture or release the working fluid between a main valve and the additional valve. The provision of two (or more) valves in any one of the working fluid flow paths (a-d) provides the possibility for the working fluid to be "trapped" for a part of a cycle of the machine, or, as the case may be, for a number of cycles of the machine. The valves may be controlled (timed) during the cycle (or a number of cycles) to capture and release the working fluid between the two valves. This may provide beneficial effects, such as, for example, isolation of the first heat exchanger during a decrease in engine load, where the "trapped" fluid eventually reaches a temperature near to that of the first heat exchanger.

Optionally, an additional heat exchanger may be provided to complement one or each of the first and second heat exchangers in order to increase the difference between temperatures of the working fluid in the expansion and compression chambers and thereby to increase the power of the machine of the invention. The or each additional heat exchanger may be arranged to use heat or cold, as applicable, from another source (e.g. from waste heat or from a cryogenerator) different from the source of the respective first or second heat exchanger. The or each additional heat exchanger is preferably controlled separately from the respective first or second heat exchanger, i.e. the additional heat exchanger can be switched on/off independently of the respective first or second heat exchanger. For example, the or each additional heat exchanger can remain switched off but can be switched on, for example, when a source of waste energy becomes available in order to increase power of the machine.

Power output of the thermodynamic machine of the invention depends upon several conditions such as, but not limited to, mean working fluid pressure, the working fluid type, temperature of a heat source supplying the heat exchanger which is used as a heater and temperature of a cold drawing heat from the heat exchanger which is used as a cooler. The efficiency of the thermodynamic machine of the invention depends upon a specific configuration of the machine. There is a maximum power output that the machine can produce for any particular speed of the output-input member.

In an advantageous modification, the valves are arranged to be controlled by, for example, appropriately timing the valves or by controlling flow apertures of the valves or a by combination of timing and flow aperture control, so as to regulate rotational speed of the output-input member of the machine and/or power output of the machine, i.e. so that the valves act as a throttle in the thermodynamic machine of the invention. For example, the valves may be controlled to match power output of the machine to output load, such as, for example, an electric generator demand on the machine. In the latter arrangement, speed control of the machine may be possible when the power output matches the demand made on the output-input member and can be achieved by adjusting the valves at frequent intervals to respond to a difference between the desired and the actual speed of rotation of the output-input member. Alternatively, the speed control may be made based upon the load, with the speed being the dependent variable.

Preferably, the machine is adapted to seamlessly switch mode between heat pump mode and engine mode and wherein the rotational output of the engine mode is in the same direction as the rotational input of the heat pump mode. More preferably, the machine is able to seamlessly switch mode between heat pump mode and engine mode without requiring to stop and/or without requiring disassembly and reassembly.

In one arrangement, the valves may be arranged to be controlled, when required, such that less than the full volume of working fluid passes through either or both of the heat exchangers. For example, the valves may be controlled so that flow of the working fluid passing through the heat exchangers varies over time and/or so that a proportion of the working fluid flows through the respective bypass conduit. Flow apertures of the valves may vary between a physical maximum and any reduced area or zero flow in a closed state of the valve. A valve opening event may be short relative to the working fluid flow through the heat exchanger, or the valve may remain open for the full duration of the flow. A combination of the flow aperture control and the control of duration of valve opening may be used to transfer sufficient amounts of heat to or from either heat exchanger to match the speed of and load demand on the machine. There may be more than one valve event per working fluid exchange event. In this case, the flow aperture can be varied in accordance with a specific pattern and frequency, e.g. pulse width modulation. The valve in the latter example may be a disc valve and may either represent one of the main valves (i.e. first, second and, if applicable, third a fourth valves) or be additional to and in series or parallel to the main valves. Furthermore, reduced heat transfer through either or both of the heat exchangers may be achieved by allowing a limited flow of the working fluid through the bypass conduits by limiting flow aperture of the respective valves in the respective bypass conduits, while keeping the flow apertures of the valves of the heat exchangers fully open. In another example, the valves in line with the heat exchangers can be controlled to open only for a certain proportion of the cycle time (e.g. 80%) such that the working fluid is forced along the respective bypass conduits for the remaining time (e.g. 20%). Preferably, valves in the bypass conduits are controlled such that the operation of the valves is sympathetic to the required flow of the working fluid through the heat exchangers and does not cause unnecessary flow losses.

Preferably, the machine incorporates a control circuit incorporating one or more sensors arranged within the machine for acquiring information on machine operating parameters and the control mechanism for controlling the valves is arranged in communication with the control circuit. Examples of the sensors include, but not limited to, shaft rotational speed, linear displacement, fluid pressure, fluid temperature and machine material temperature sensors. The control mechanism is preferably an electronic computer control system. An alternative control mechanism such as a mechanical governor may be used in particular applications.

According to a second aspect of the invention there is provided a method of operating a thermodynamic machine as an engine and/or as a heat pump of a Stirling cycle type, the method comprising the steps of:— a) providing a thermodynamic machine operable as a heat engine and/or as a heat pump, the thermodynamic machine comprising
   - an expansion cylinder defining an expansion chamber, a compression cylinder defining a compression chamber and respective pistons reciprocally movable in the chambers during operation of the machine;
   - a regenerator disposed between and in communication with the expansion and compression chambers;
   - a first heat exchanger in communication with the expansion chamber and the regenerator and a second heat exchanger in communication with the compression chamber and the regenerator;

a first bypass conduit connecting the expansion chamber with the regenerator bypassing the first heat exchanger and a second bypass conduit connecting the compression chamber with the regenerator bypassing the second heat exchanger; wherein the machine comprises at least a pair of valves one valve being provided between the expansion chamber and the first heat exchanger or between the first heat exchanger and the regenerator or in the first bypass conduit between the expansion chamber and the regenerator;

and the other valve being provided between the compression chamber and the second heat exchanger or between the second heat exchanger and the regenerator or in the second bypass conduit between the compression chamber and the regenerator; and b) timing at least one of the valves, i.e. controlling flow through the or each valve over time, so as to direct working fluid of the machine between the regenerator and the expansion and compression chambers either substantially through the respective bypass conduit or substantially through the respective heat exchanger at pre-determined stages of the machine cycle.

Preferably, the regenerator comprises a regenerator chamber and wherein the thermodynamic machine is arranged such that substantially the whole volume of a working fluid will pass through said regenerator chamber twice during a single cycle of the thermodynamic machine;

Preferably, step b) further comprises timing at least one of the valves such that flow of working fluid is controlled through the or each valve over time at least once during each cycle of the thermodynamic machine, so as to direct working fluid of the machine between the regenerator and the expansion and compression chambers either substantially through the respective bypass conduit or substantially through the respective heat exchanger at pre-determined stages of the machine cycle.

Preferably, the step b) is carried out using a control mechanism. Preferably, the machine is in accordance with the first aspect of the invention.

Preferably, the method further comprises the step of actively actuating the or each valve, i.e. applying an external force open or close the or each valve.

Preferably, the method comprises the step of adjusting in real time the timing of the or each valve in accordance with actual operating conditions, thereby further optimising machine efficiency and power output.

Preferably, the method comprises the step of operating the machine in one or each of a heat engine mode in which thermal input is converted into mechanical work or a heat pump mode in which mechanical work is converted into thermal output. Further preferably, operating the machine in the heat pump mode comprises providing a positive thermal output, i.e. operating the machine as a heater or a negative thermal output, i.e. operating the machine such that it operates as a cooler or refrigerator.

Preferably, the method comprises the step of timing the or each valve accordingly in the heat engine mode or the heat pump mode, wherein valve timing in the heat engine mode may differ from valve timing in the heat pump mode. Preferably, the method comprises adjusting the timing of the or each valve, depending on which mode the machine is operating in.

In one arrangement, the method comprises, providing one valve between the expansion chamber and the regenerator at the first heat exchanger and providing the other valve between the compression chamber and the regenerator at the second heat exchanger.

Preferably, the step of timing the valves in the heat engine mode comprises substantially closing the valve at the second heat exchanger during a compression stroke of the piston in the compression cylinder so as to direct the working fluid to the regenerator substantially through the second bypass conduit substantially bypassing the second heat exchanger. Further preferably, the step of timing the valves in the heat engine mode comprises substantially closing the valve at the first heat exchanger during a backward stroke of the piston in the expansion cylinder (i.e. when the piston is moving back after an expansion stroke), so as to direct the working fluid to the regenerator substantially through the first bypass conduit substantially bypassing the first heat exchanger.

Preferably, the step of timing the valves in the heat pump mode (whether the machine is operating as a heater or as a refrigerator) comprises substantially opening the valve at the second heat exchanger during a compression stroke of the piston in the compression cylinder, and, preferably, substantially closing the valve at the first heat exchanger so as to direct the working fluid to the regenerator through the second heat exchanger thereby rejecting heat gained during compression via the second heat exchanger. Further preferably, the step of timing the valves in the heat pump mode (whether the machine is operating as a heater or as a refrigerator) comprises substantially opening the valve the first heat exchanger during an expansion stroke of the piston in the expansion cylinder, and, preferably, substantially closing the valve at the second heat exchanger so as to cause heat to be transferred form surroundings of the first heat exchanger into the expansion chamber.

Preferably, the method comprises the step of providing the machine with four valves wherein a first valve is provided between the expansion chamber and the first heat exchanger or between the first heat exchanger and the regenerator and a second valve is provided in the first bypass conduit between the expansion chamber and the regenerator;

a third valve is provided between the compression chamber and the second heat exchanger or between the second heat exchanger and the regenerator and a fourth valve is provided in the second bypass conduit between the compression chamber and the regenerator; and wherein at least one of the first, second, third and fourth valves is controllable.

Preferably, the method comprises timing all the four valves.

Preferably, the step of timing the valves in the heat engine mode comprises substantially closing the third valve and substantially opening the fourth valve during a compression stroke of the piston in the compression cylinder so as to direct the working fluid to the regenerator substantially through the second bypass conduit substantially bypassing the second heat exchanger. Preferably, the method further comprises the step of concurrently substantially opening the first valve and substantially closing the second valve, so that upon exiting the regenerator, the working fluid is directed to the expansion chamber substantially through the first heat exchanger, substantially bypassing the first bypass conduit, whereby the working fluid becomes further heated to provide the working fluid with sufficient energy to effect an expansion stroke in the expansion cylinder.

Further preferably, the step of timing the valves in the heat engine mode comprises substantially closing the first valve and substantially opening the second valve during a backward stroke of the piston in the expansion cylinder so as to direct the working fluid to the regenerator substantially through the first bypass conduit substantially bypassing the first heat exchanger. Preferably, the method further comprises the step of concurrently substantially opening the third valve and substantially closing the fourth valve, whereby upon exiting the regenerator, the working fluid is directed to the compression chamber substantially through the second heat exchanger, i.e. the cooler, substantially bypassing the second bypass conduit, whereby as the working fluid is further cooled as it passes through the second heat exchanger, such that the working fluid still has enough energy to move the piston in the compression cylinder but is cooled sufficiently to reduce the work required to subsequently compress the working fluid in the compression.

Preferably, the method comprises the step of driving the output-input member externally in the heat pump mode of the machine (whether operating as a heater or as a refrigerator) to provide mechanical input to drive the pistons of the cylinders. Further preferably, in the heat pump mode the method comprises the step of starting the expansion process with the temperature of the working fluid being lower than that during the compression process, whereby the temperature of the working fluid is further lowered upon expansion. Preferably, the step of timing the valves in the heat pump mode comprises substantially opening the third valve and substantially closing the fourth valve during a compression stroke of the piston in the compression cylinder whereby the working fluid is directed to the regenerator substantially through the second heat exchanger, substantially bypassing the second bypass conduit, whereby heat gained by the working fluid during compression is dissipated into the ambient through the second heat exchanger. In the heater mode the space around the second heat exchanger is the space to be heated by the heat ejected by the second heat exchanger, whereas in the refrigerator mode, the space around the second heat exchanger is where excess heat produced during the cycle is disposed of. Preferably, the method further comprises the step of concurrently substantially closing the first valve and substantially opening the second valve, whereby upon exiting the regenerator, the working fluid is directed to the expansion chamber substantially through the first bypass conduit substantially bypassing the first heat exchanger.

Further preferably, the step of timing the valves in the heat pump mode of the machine (whether operating as a heater or as a refrigerator) comprises substantially opening the first valve and substantially closing the second valve during the expansion stroke in the expansion cylinder, whereby the working fluid is directed to the expansion cylinder from the regenerator substantially through the first heat exchanger, substantially bypassing the first bypass conduit, whereby, as the pressure drops during the expansion stroke, the working fluid which has already cooled in the regenerator is cooled still further. Since the temperature in the expansion chamber becomes lower than that of the external space around the first heat exchanger, heat from the external space is drawn through the first heat exchanger to heat the working fluid. In the heater mode the space around the first heat exchanger is used as a source of heat, whereas in the refrigerator mode, the space around the first heat exchanger is the space to be cooled. Preferably, the method further comprises the step of concurrently substantially closing the third valve and substantially opening the fourth valve.

Further preferably, the step of timing the valves in the heat pump mode of the machine (whether operating as a heater or as a refrigerator) comprises keeping the first valve substantially open and the second valve substantially closed during a backward stroke of the piston in the expansion cylinder, whereby the working fluid is directed to the regenerator substantially through the first heat exchanger substantially bypassing the first bypass conduit, whereby the working fluid is moved to the regenerator and becomes heated in the regenerator using the heat retained during the previous pass. Preferably, the method further comprises the step of concurrently keeping the third valve substantially closed and the fourth valve substantially open whereby upon exiting the regenerator, the working fluid is directed to the compression chamber substantially through the second bypass conduit substantially bypassing the second heat exchanger, whereby a forward (i.e. expansion) stroke in the compression cylinder begins at elevated temperature so as to obtain the required level of heat during the subsequent compression for subsequent ejection through the second heat exchanger. During the outward stroke in the compression cylinder, the working fluid continues to receive heat from the regenerator.

The method may comprise providing additional valves between the regenerator and one or each of the expansion and compression chambers.

Preferably, the step of timing of the valves may be the same in the heater and in the refrigerator mode or the timing of the valves may be reconfigured between the heater mode and in the refrigerator mode. Further preferably, the method comprises the step of beginning the compression process with the working fluid being at ambient temperature when operated in the refrigerator mode. Further preferably, the method comprises the step of beginning the expansion process at room temperature in the heater mode so that heat is rejected into the space around the compression cylinder at elevated temperature.

Typically, the said at least one controllable valve is capable of being infinitely adjusted such that it can be controlled between any and all of the following configurations:— i) fully closed such that no working fluid can pass there-through;

ii) fully open such that working fluid can pass there-through substantially without restriction; and iii) any position between fully open and fully closed such that the valve comprises an aperture having an area through which working fluid is capable of flowing;

and wherein the area of the aperture and/or the phasing and/or timing of the movement between the positions i), ii) and/or iii) is infinitely adjustable between the fully open and fully closed positions.

Typically, the said at least one controllable valve is capable of being infinitely adjusted at any point in time in terms of phasing within the cycle of the thermodynamic machine and/or in terms of the stages of operation of the thermodynamic machine.

Typically, the said at least one controllable valve is capable of being infinitely adjusted at any point in time in terms of the duration of time in which the valve will remain in any one of configurations i), ii) or iii).

Preferably, the regenerator chamber comprises a single chamber such that substantially the whole volume of a working fluid will pass through said single regenerator chamber twice during a single cycle of the thermodynamic machine. More preferably, the regenerator chamber comprises a single chamber such that substantially the whole volume of a working fluid will pass through said single regenerator chamber once in a first direction and once in a second, reverse, direction during a single cycle of the thermodynamic machine.

Alternatively, the regenerator chamber comprises two or more chambers connected in series such that substantially the whole volume of a working fluid will pass through said two or more regenerator chambers twice during a single cycle of the thermodynamic machine.

The regenerator chamber typically comprises a thermal storage medium and the said chamber is adapted to intermittently store heat from a relatively hot working fluid in said thermal storage medium as the relatively hot working fluid contacts said thermal storage medium as it passes through said regenerator chamber in a first direction.

The regenerator chamber typically comprises a thermal storage medium and the said chamber is adapted to intermittently transfer heat from the said thermal storage medium to a relatively cold working fluid as the relatively cold working fluid contacts said thermal storage medium as it passes through said regenerator chamber in a second, reverse, direction.

It will be appreciated that features of the first and second aspects of the invention may be provided in conjunction each other where appropriate.

DESCRIPTION OF PREFERRED EMBODIMENTS

Embodiments of the present invention will now be described, by way of example only, with reference to the accompanying drawings in which:—

Figure 1B:
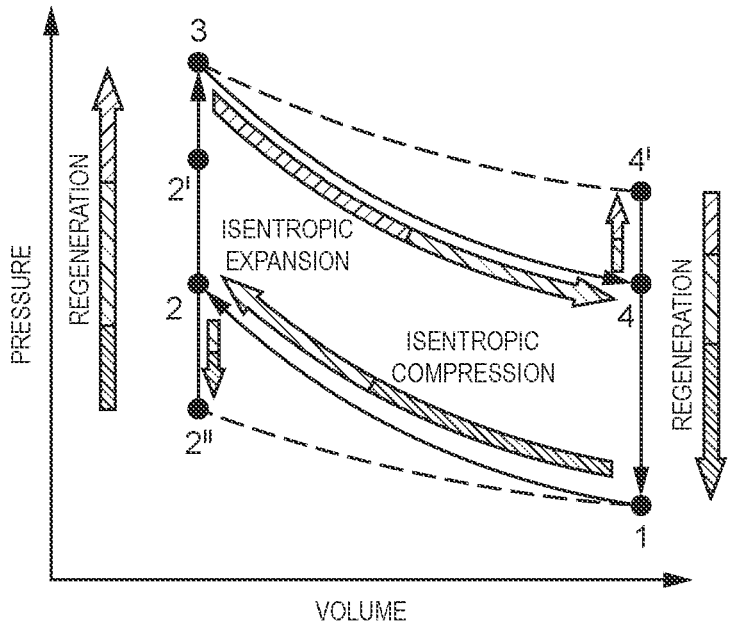

FIG. 1*a* is a schematic illustration of phases of an ideal pseudo-Stirling cycle in a prior art Stirling engine;

FIG. 1*b* is a pressure/volume graph of the ideal pseudo Stirling cycle of the Stirling engine of FIG. 1*a;*

Figure 1C:
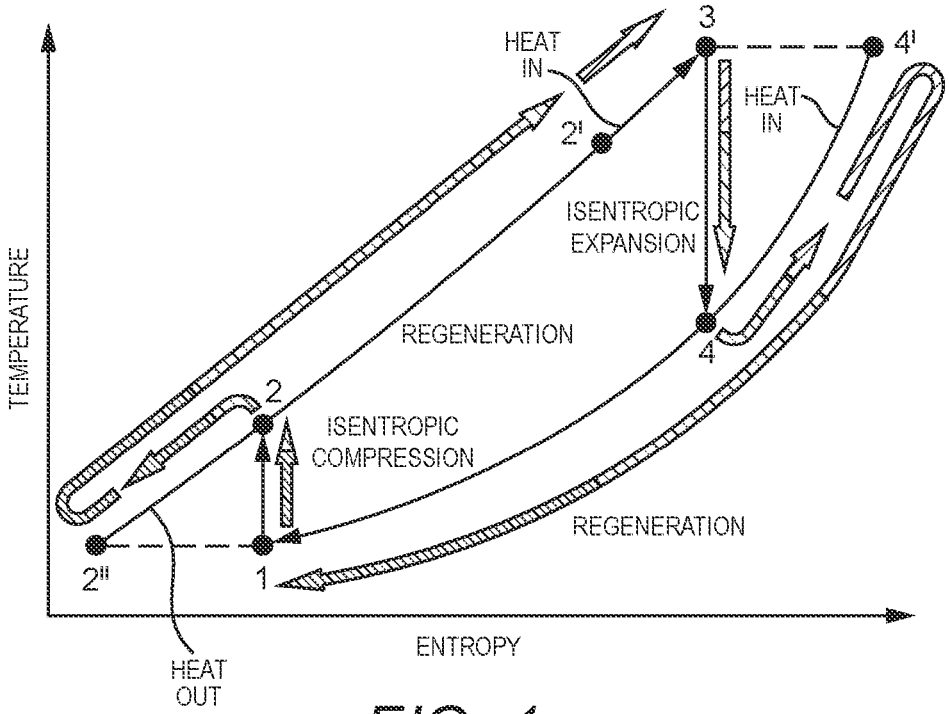

FIG. 1*c* is a temperature/entropy graph of the ideal pseudo Stirling cycle of the Stirling engine of FIG. 1*a;*

Figure 2A:
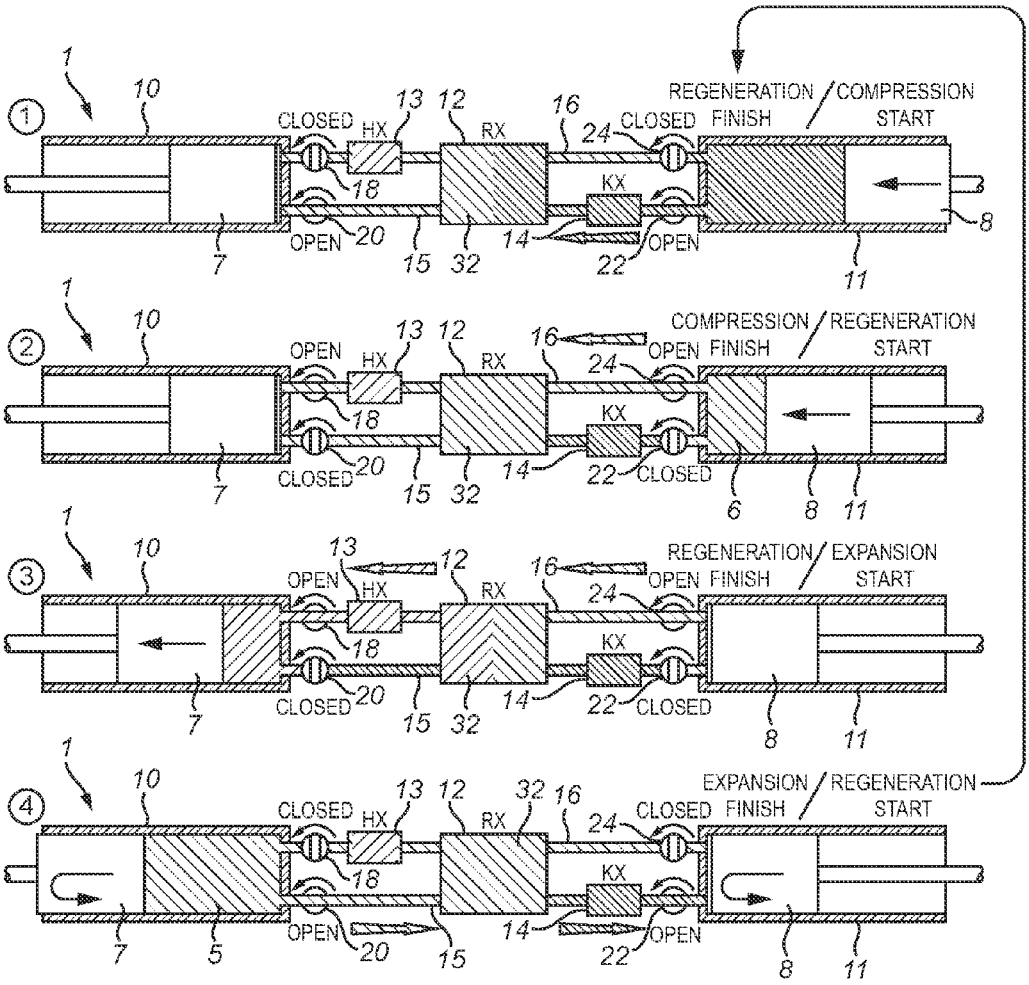
Figure 2B:
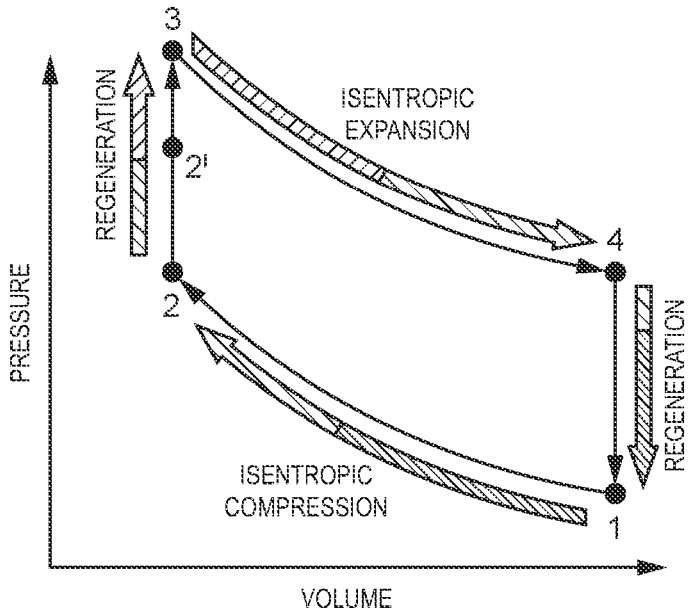

FIG. 2*a* is a schematic illustration of phases of an ideal pseudo-Stirling cycle in a thermodynamic machine in accordance with the present invention;

FIG. 2*b* is a pressure/volume graph of the ideal pseudo Stirling cycle of the thermodynamic machine of FIG. 2*a;*

Figure 2C:
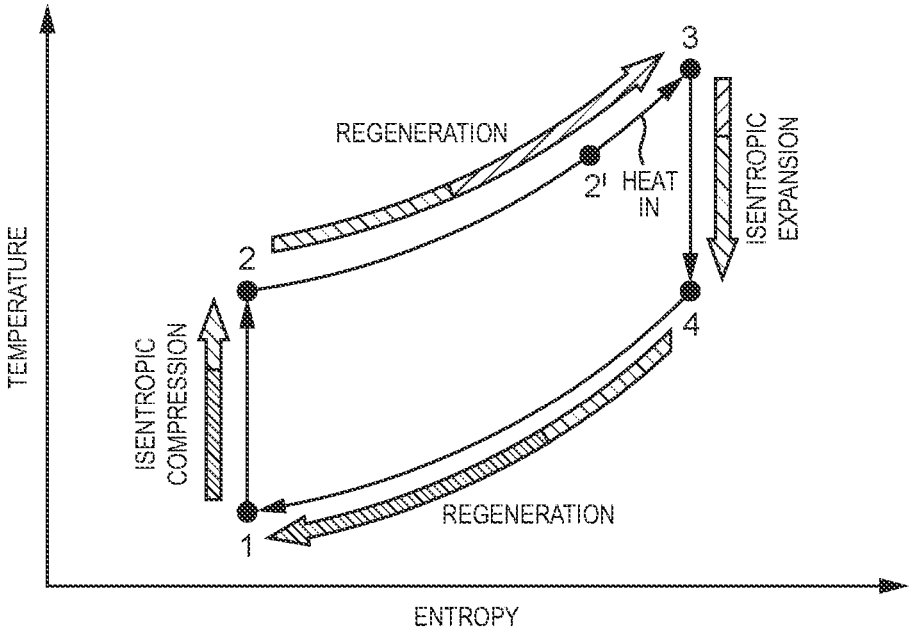

FIG. 2*c* is a temperature/entropy graph of the ideal pseudo Stirling cycle thermodynamic machine of FIG. 2*a;*

Figure 4A:
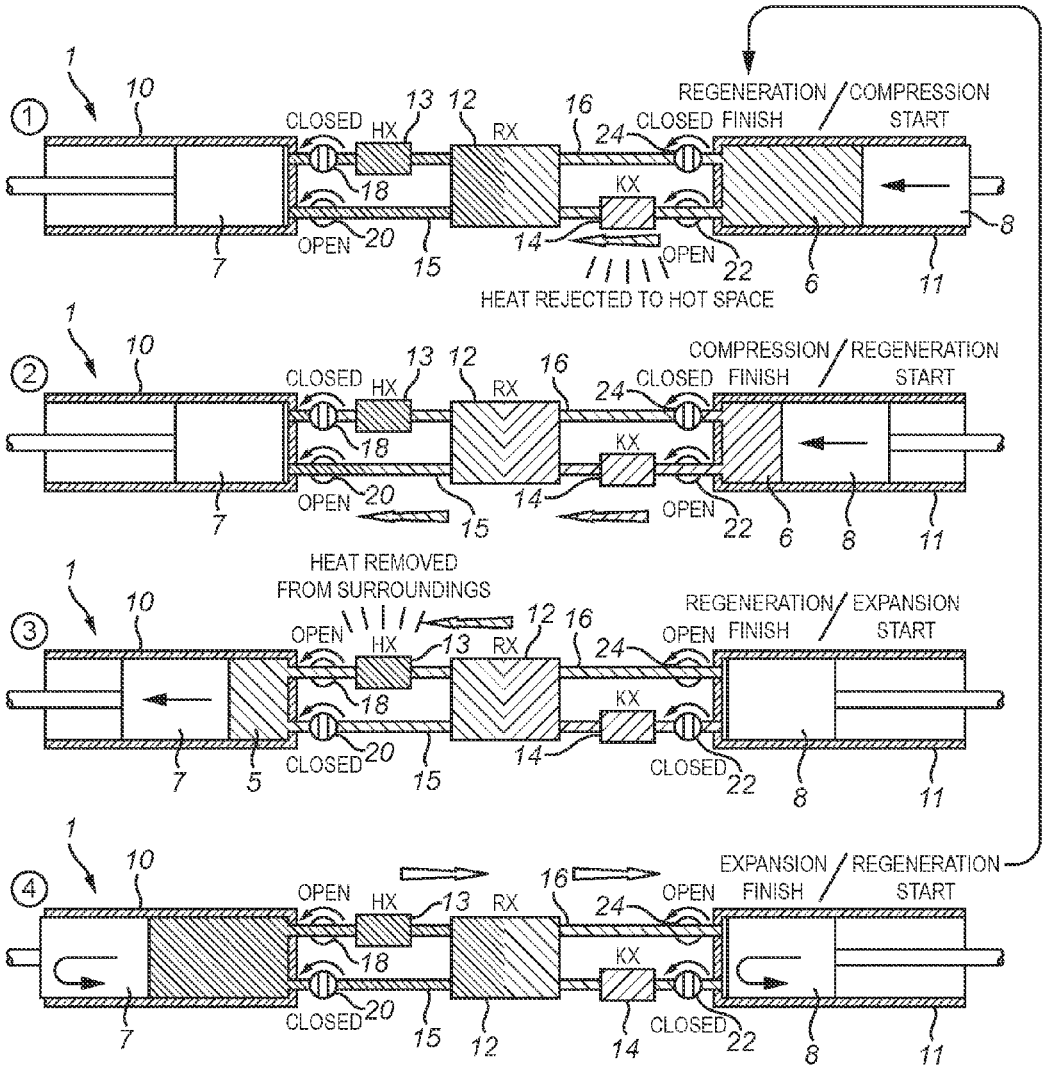
Figure 4B:
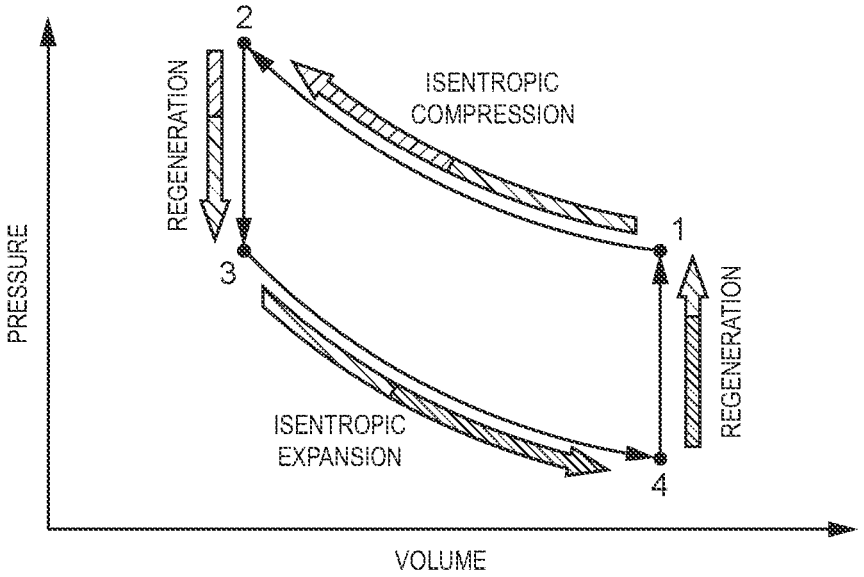

FIGS. 3*a* to 3*h* are schematic illustrations of phases of an ideal pseudo-Stirling cycle in an "alpha" type V-configuration thermodynamic machine in accordance with the present invention;

FIG. 4*a* is a schematic illustration of phases of an ideal pseudo-Stirling cycle in a thermodynamic machine in accordance with the present invention operating in a heat pump mode;

FIG. 4*b* is a pressure/volume graph of the ideal pseudo Stirling cycle of the thermodynamic machine of FIG. 4*a;*

Figure 4C:
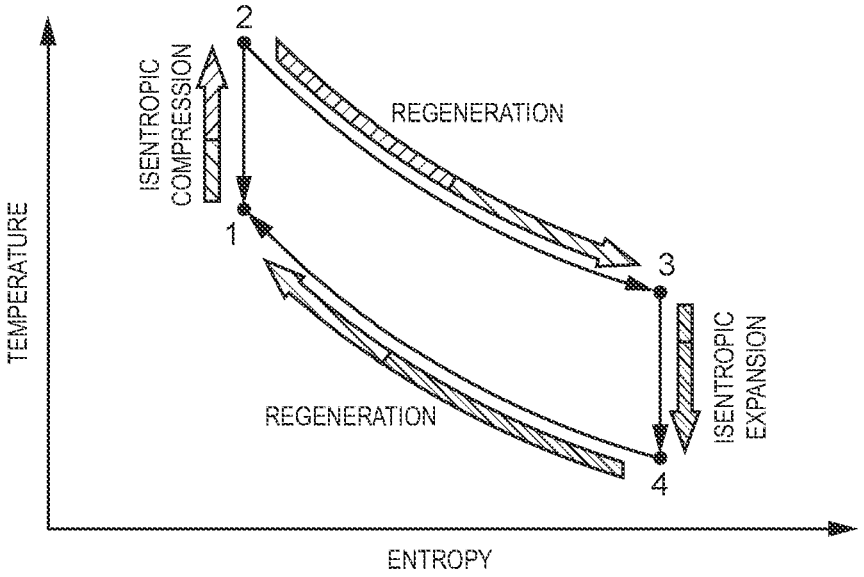

FIG. 4*c* is a temperature/entropy graph of the ideal pseudo Stirling cycle thermodynamic machine of FIG. 4*a;*

Figure 5A:
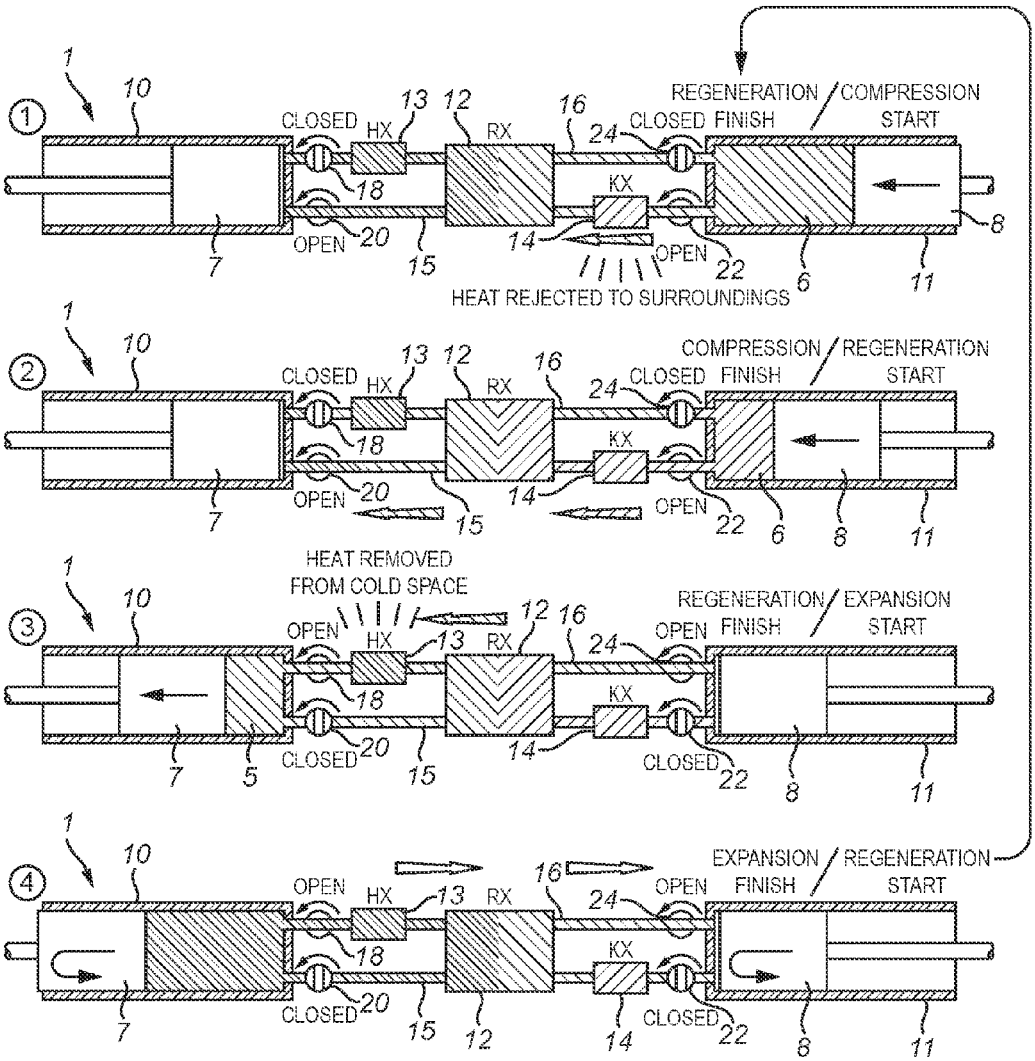
Figure 5B:
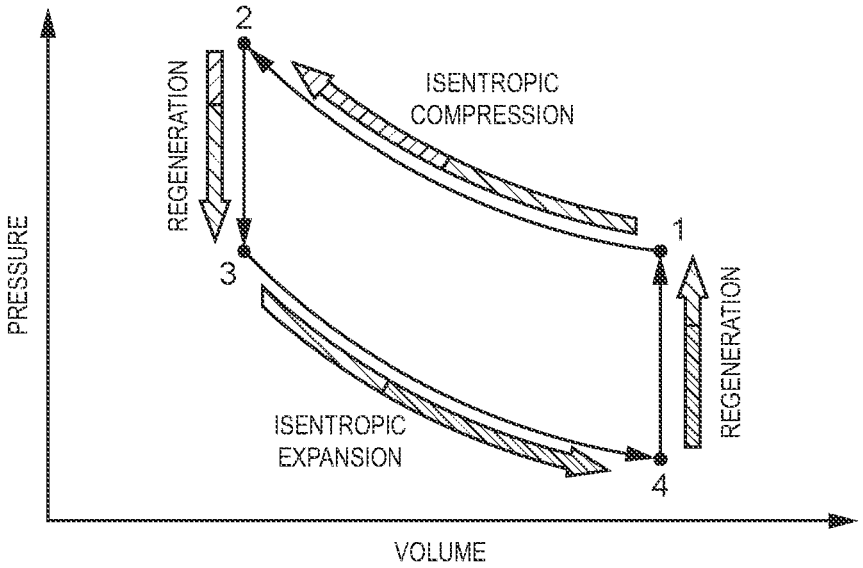
Figure 5C:
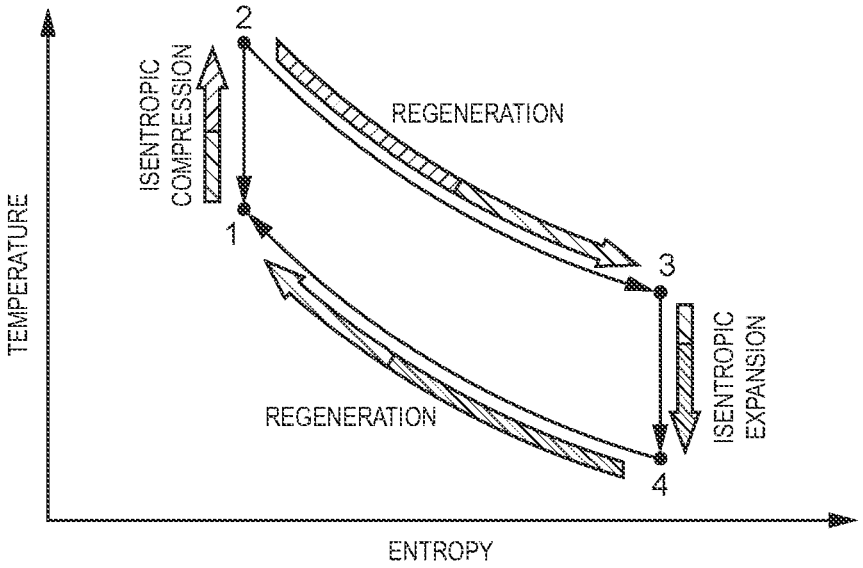

FIG. 5*a* is a schematic illustration of phases of an ideal pseudo-Stirling cycle in a thermodynamic machine in accordance with the present invention operating in a refrigerator mode;

FIG. 5*b* is a pressure/volume graph of the ideal pseudo Stirling cycle of the thermodynamic machine of FIG. 5*a*; and FIG. 5*c* is a temperature/entropy graph of the ideal pseudo Stirling cycle thermodynamic machine of FIG. 5*a*.

With reference initially to FIG. 2*a*, a schematically illustrated embodiment of a thermodynamic machine of a Stirling cycle type according to the present invention is shown, generally indicated by reference numeral 1. It will be appreciated that herein the term "machine" is used to denote a physical entity which can function, in one mode of operation, as an engine, i.e. to convert thermal input into mechanical work or, in another mode of operation, as a heat pump to convert mechanical input into a thermal output, i.e. to function as a heater and/or as a refrigerator. The machine comprises an expansion cylinder 10 defining an expansion chamber 5, a compression cylinder 11 defining a compression chamber 6 and respective pistons 7, 8 reciprocally movable in the chambers 5, 6 during operation of the machine 1. The machine 1 further comprises a regenerator 12 disposed between and in communication with the expansion and compression chambers 5, 6 where the regenerator 12 comprises a chamber 32 through which, in use, substantially the whole volume of a working fluid will pass through said single regenerator chamber 32 once in a first direction and once in a second, reverse, direction during a single cycle of the machine 1. As will become apparent, the regenerator chamber 32 comprises a thermal storage medium (not shown) and the said thermal storage medium is adapted to intermittently store heat from a relatively hot working fluid as the relatively hot working fluid contacts said thermal storage medium as it passes through said regenerator chamber in a first direction and intermittently transfers said heat to a relatively cold working fluid as the relatively cold working fluid contacts said thermal storage medium as it passes through said regenerator chamber 32 in a second, reverse, direction.

The machine 1 is thus a Stirling cycle type and comprises a closed-cycle regenerative heat engine with a permanently gaseous working fluid due to the working fluid being permanently contained within the machine 1 and the volume of working fluid commingles as one single volume (which is a variable volume depending upon the stage of the machine through its cycle) and is not split into two or more separate volumes having separate circuits of flow of working fluid which cannot commingle like non-Stirling cycle type machines.

A first heat exchanger 13 is provided adjacent the expansion chamber 5 in fluid communication with the expansion chamber 5 and the regenerator 12. A second heat exchanger 14 is provided adjacent the compression chamber 6 in fluid communication with the compression chamber 6 and the regenerator 12. A first bypass conduit 15 fluidly connects the expansion chamber 5 with the regenerator 12 bypassing the first heat exchanger 13. A second bypass conduit 16 fluidly connects the compression chamber 6 with the regenerator 12 bypassing the second heat exchanger 14. A first controllable valve 18 is provided between the expansion chamber 5 and the first heat exchanger 13 and a second controllable valve 20 is provided in the bypass conduit 15 between the expansion chamber 5 and the regenerator 12. A third controllable valve 22 is provided between the compression chamber 6 and the second heat exchanger 14 and a fourth controllable valve 24 is provided in the second bypass conduit 16 between the compression chamber 6 and the regenerator 12. Although not shown in the drawings, a control mechanism comprising a programmable microprocessor based electronic control module is provided and is configured to time the opening and closing of each of the valves 18, 20, 22, 24, i.e. to control the flow through the valves 18, 20, 22, 24 over time, so as to direct working fluid (gas, e.g. helium or air) of the machine 1 between the regenerator 12 and the expansion and compression cylinders 10, 11 either substantially through the respective bypass conduits 15, 16 or substantially through the respective heat exchangers 13, 14 at pre-determined stages of the machine cycle, as will be described in more detail below.

Furthermore, it should be noted that additional valves (not shown in the drawings) could be included. For example, an additional valve can be provided between the first heat exchanger and the regenerator and/or between the second heat exchanger and the regenerator. A further additional valve can be provided in one or each of the first bypass conduit 15 and the second bypass conduit 16, preferably, nearer the regenerator end of the relevant bypass conduit 15, 16. Optionally, although not shown in the drawings, an additional heat exchanger may be provided to complement one or each of the first and second heat exchangers 13, 14 in order to increase the difference between temperatures of the working fluid in the expansion and compression chambers 5, 6 and thereby to increase the power of the machine 1. The or each additional heat exchanger may be arranged to use heat or cold, as applicable, from another source (e.g. from waste heat or from a cryogenerator) different from the source of the respective first or second heat exchanger 13, 14. The or each additional heat exchanger may be controlled separately from the respective first or second heat exchanger 13, 14, i.e. the additional heat exchanger can be switched on/off independently of the respective first or second heat exchanger 13, 14. The or each additional heat exchanger can remain switched off but can be switched on, for example, when a source of waste energy becomes available in order to increase power of the machine 1.

It will be appreciated that, although the presently described specific embodiment of the machine includes four valves, two valves, one provided between the expansion chamber and the first heat exchanger or between the first heat exchanger and the regenerator or in the first bypass conduit between the expansion chamber and the regenerator; and the other provided between the compression chamber and the second heat exchanger or between the second heat exchanger and the regenerator or in the second bypass conduit between the compression chamber and the regenerator are sufficient to implement the invention, as will be readily understood by persons skilled in the art.

As is typical for Stirling machines, the first heat exchanger 13 functions as a heater (and will referred to as such below), i.e. it is configured to transfer heat from outside the expansion cylinder 10 to the working fluid in the expansion chamber 5, whereas the second heat exchanger 14 functions as a cooler (and will referred to as such below), i.e. it is configured to transfer heat from the working fluid in the compression chamber 6 to the ambient outside the compression cylinder 11. The pistons 7, 8 of the cylinders 10, 11 are connected to a common output-input member, such as a crankshaft 30 shown in FIGS. 3*a* to 3*h*.

The valves 18, 20, 22, 24 are actively actuated valves, i.e. of the type which require an external force to be applied to open or close the valves 18, 20, 22, 24, rather than being passive, i.e. actuated by the energy of the working fluid of the machine. In the presently described embodiments the valves 18, 20, 22, 24 are rotary valves actuated by a mechanical or an electromechanical drive (not shown) but other types of suitable valves could be used instead of rotary valves, such as, for example, poppet valves.

The control mechanism of the machine 1 is adapted to adjust in real time the timing of the valves 18, 20, 22, 24 in accordance with actual operating conditions, thereby further optimising machine efficiency and power output and in practice, at least one of the valves 18, 20, 22, 24 and more preferably all of the valves 18, 20, 22, 24 will be controlled at least once, and even more preferably more than once, during each cycle of the machine 1. Moreover, the valves 18, 20, 22, 24 are capable of being infinitely adjusted such that they can be controlled between any and all of the following configurations:— i) fully closed such that no working fluid can pass there-through;

ii) fully open such that working fluid can pass there-through substantially without restriction; and iii) any position between fully open and fully closed such that the valve comprises an aperture (not shown) having an area (which is less than the area of the fully open configuration) through which working fluid is capable of flowing;

and the area of the aperture (not shown) and/or the phasing and/or timing of the movement between the positions i), ii) and/or iii) is infinitely adjustable between the fully open and fully closed positions.

As will be described below in more detail, the machine 1 can operate in a heat engine mode, in which thermal input of the heater 13 is converted into mechanical work or in a heat pump mode, in which mechanical work of the crankshaft 30 is converted into thermal output, i.e. heating or cooling the ambient. In the heat pump mode, the machine 1 can operate as a heater, i.e. use the heat rejected by the cooler 14 to heat the surrounding space, or as a cooler or refrigerator, i.e. to take heat away from space via the heater 13. The control mechanism is configured to time the valves 18, 20, 22, 24 accordingly in the heat engine mode and the heat pump mode since valve timing in the heat engine mode differs from valve timing in the heat pump mode. Depending on which mode the machine 1 is operating in, the control mechanism adjusts the timing of the valves 18, 20, 22, 24 accordingly.

Typical textbook descriptions of the Stirling cycle are based on highly idealised conditions which bear little resemblance to real operation of a Stirling machine. In particular the expansion and compression processes are assumed to occur isothermally, a situation highly unlikely to exist in practice due to the thickness of walls of the expansion and compression cylinders and the limited time available for heat transfer between the cylinders and the heat exchangers at realistic machine speeds. For practical purposes it is more appropriate to assume the following:—

1. The compression and expansion cylinders are adiabatic, i.e. no heat transfer occurs between the cylinders and respective heat exchangers. As a result, the temperature of the working fluid in the compression and expansion cylinders varies with time during piston strokes, i.e. rises during compression and drops during expansion.

2. Constant temperature heat exchangers are provided adjacent to the compression and expansion cylinders.

3. The regenerator is imperfect, i.e. it releases less heat than it absorbs. If the regenerator is working under ideal conditions, the outlet temperature of hot blow would be at the inlet temperature of cold blow. The regenerator, due to design and material constraints, cannot absorb the total heat from constant volume transfer process, from high to low temperature, and therefore cannot provide the total heat necessary for subsequent constant volume transfer process, from low to high temperature.

4. Piston strokes remain assumed to be highly idealised in order to simplify the cycle description.

The cycle occurring under the described above assumed conditions is often referred to as an ideal pseudo-Stirling cycle. The Ideal Pseudo-Stirling Cycle occurring in a prior art Stirling machine operating in heat engine mode is illustrated in FIGS. 1*a* to 1*c* and consists of the following processes. During process 1 to 2 the working fluid, typically, gas, is compressed in a compression cylinder 101 of a prior art Stirling machine 100. Since the compression cylinder 101 is assumed to be adiabatic, the temperature of the working fluid rises during compression. During process 2-3, following compression to state 2 and heating, the working fluid is then cooled to state 2" (FIGS. 1*b* and 1*c*) by a cooler 110 of the compression cylinder 101 before being passed to a regenerator 120 where the working fluid becomes heated again from state 2" to 2' at constant volume using heat retained during the previous pass. This process is counter-productive and inefficient. After regeneration, the additional heat required to achieve state 3 is supplied by heater 130 of an expansion cylinder 140 of the machine 100. During process 3 to 4 the working fluid expands and cools adiabatically in the expansion cylinder 140, producing mechanical work. During process 4-1, as the cooled working fluid is moved towards the regenerator 120 to give away the heat to the regenerator 120, the working fluid is heated by the heater 130 to state 4' before passing through the regenerator 120. This process is also counter-productive since all this additional heat will not be captured and stored in the regenerator 120 during the passage of the working fluid through the regenerator 120. The working fluid is then cooled, at constant volume, during the regeneration process between states 4' and 1 giving up its heat to regenerator 120 which stores the energy for use in the following cycle. After regeneration, the working fluid is further cooled by the cooler 110 to achieve state 1 so that the cycle can be repeated.

The Ideal Pseudo-Stirling Cycle occurring in a thermodynamic machine 1 of the present invention operating in heat engine mode is illustrated in FIGS. 2*a* to 2*c* and consists of the following processes. During process 1-2 the working fluid is compressed in the compression cylinder 11 and is heated adiabatically. The control mechanism times the valves 22, 24 so that during a compression stroke of the piston 8 in the compression cylinder 11, the third valve 22 is substantially closed whereas the fourth valve 24 is substantially open so that the working fluid is directed to the regenerator 12 substantially through the second bypass conduit 16, thereby substantially bypassing the cooler 14. During process 2-3, the working fluid is heated from state 2 to 2', at constant volume, by the regenerator 12 using heat recovered at the end of the previous cycle. After regeneration, the additional heat required to achieve state 3 is supplied by the heater 13. At the same time, the first valve 18 is substantially open and the second valve 20 is substantially closed, so that upon exiting the regenerator 12, the working fluid is directed to the expansion chamber 5 substantially through the heater 13, because it is prevented from passing through the first bypass conduit by closed second valve 20. As the working fluid passes through the heater 13 it is heated still further to achieve state 3 to provide the working fluid with sufficient energy to effect an expansion stroke in the expansion cylinder 10. During process 3-4, the heated working fluid expands in the expansion chamber 5, causing the piston 7 to move out in the expansion stroke thus producing useful mechanical work. During the expansion stroke, the working fluid expands and cools adiabatically as its energy becomes converted into mechanical work. During process 4-1, following expansion to state 4 in the expansion cylinder 10, the working fluid is moved towards the regenerator 12 during a backward, or compression stroke of the piston 7 which is driven by momentum of the output-input member (e.g. flywheel/crankshaft assembly). The control mechanism times the valves 18, 20 so that during the backward stroke of the piston 7 in the expansion cylinder 10, the first valve 18 is substantially closed whereas the second valve 20 is substantially open. Thus the working fluid is directed to the regenerator 12 substantially through the first bypass conduit 15 substantially bypassing the heater 13. In the regenerator 12, the heat of the working fluid is retained in the regenerator 12 at constant volume and stored for use in the next cycle. At the same time, the third valve 22 is substantially open and the fourth valve 24 is substantially closed, so that upon exiting the regenerator 12, the working fluid is directed to the compression chamber 6 substantially through the cooler 14, because it is prevented from passing along the second bypass conduit 16 by the closed fourth valve 24. As the working fluid passes through the cooler 14, the working fluid is further cooled such that the working fluid still has enough energy to move the piston 8 in the compression cylinder 11 but is cooled sufficiently to reduce the work required to subsequently compress the working fluid in the compression cylinder 11. In the compression chamber 6, the working fluid causes the piston 8 to move out in the outward stroke. During the expansion stroke in the compression cylinder 11, the working fluid further cools to achieve state 1 as its energy becomes converted into mechanical work. After the outward stroke in the compression cylinder 11, the cycle begins again.

Figure 3A:
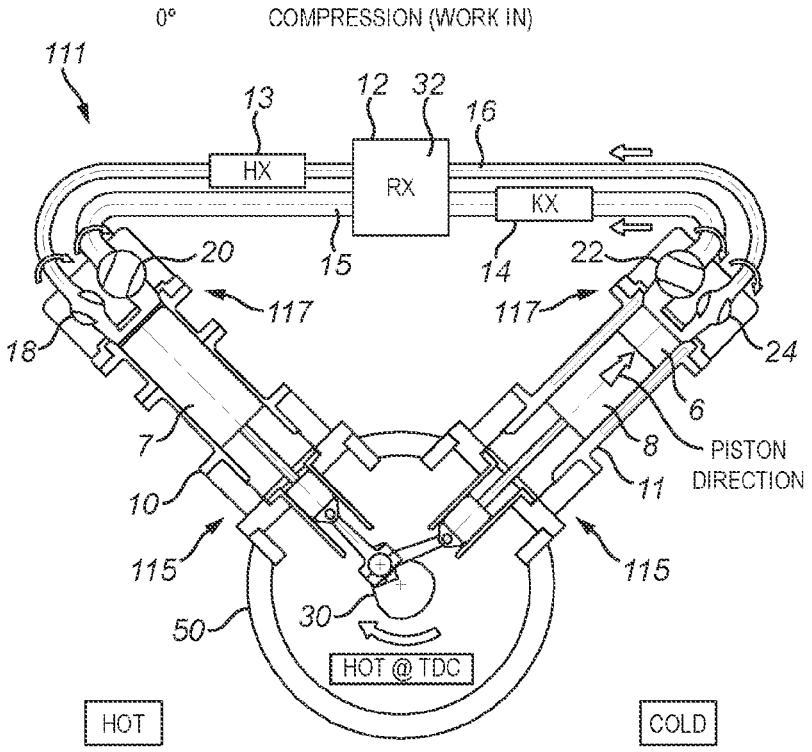
Figure 3B:
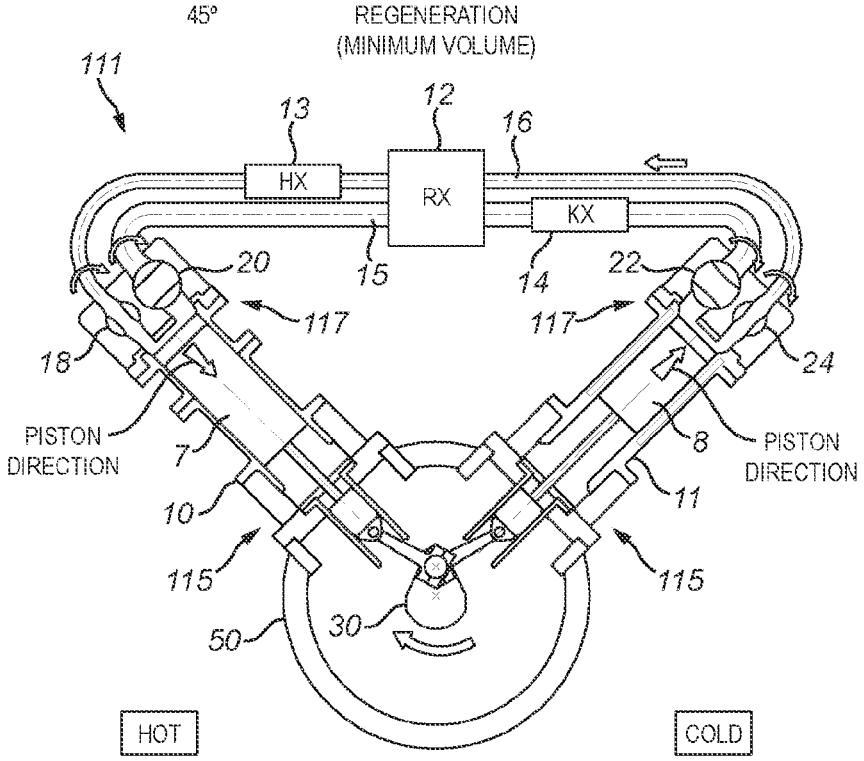
Figure 3C:
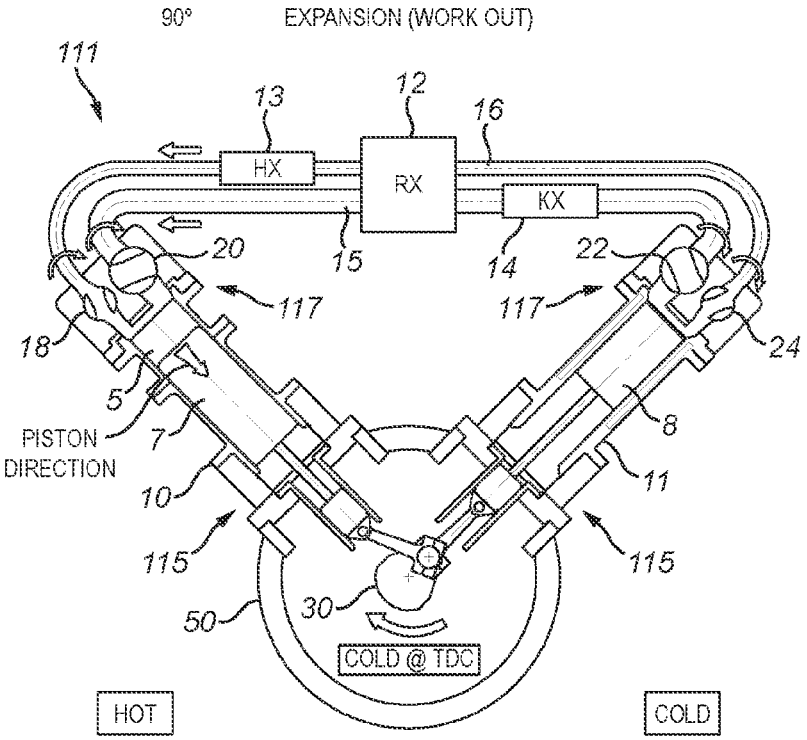
Figure 3D:
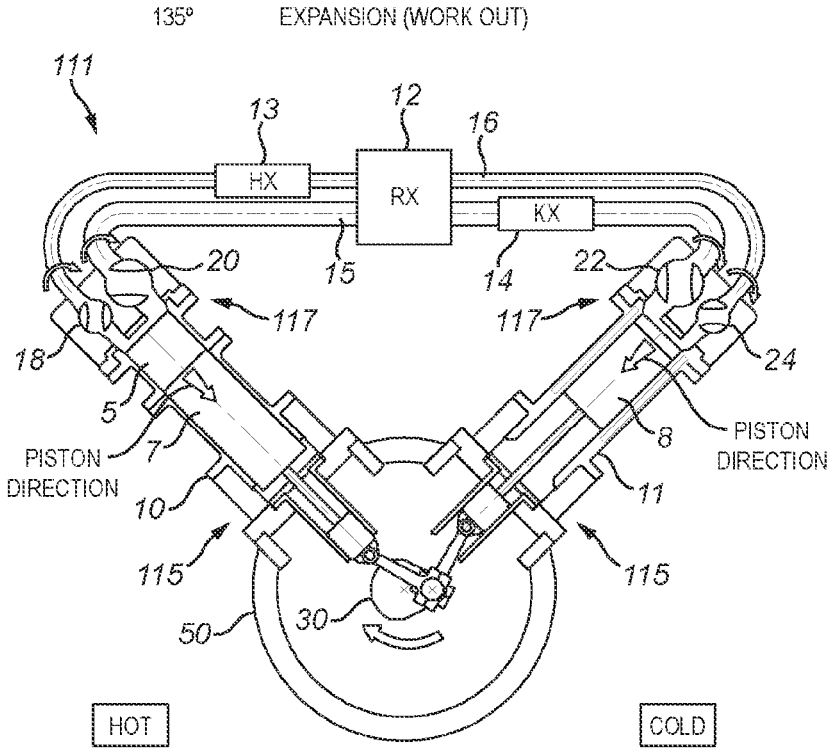
Figure 3E:
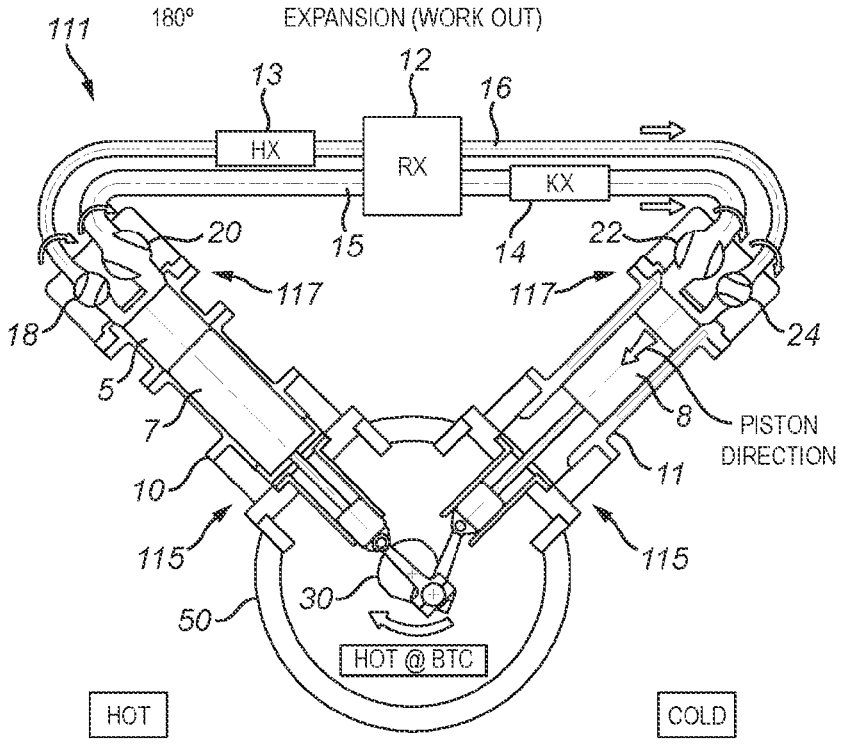
Figure 3F:
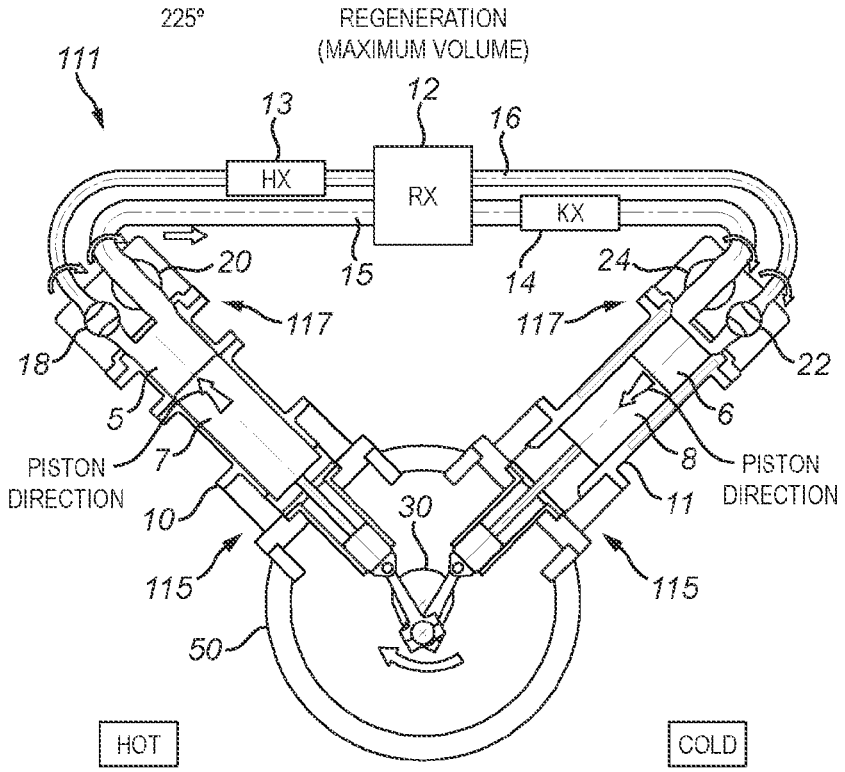
Figure 3G:
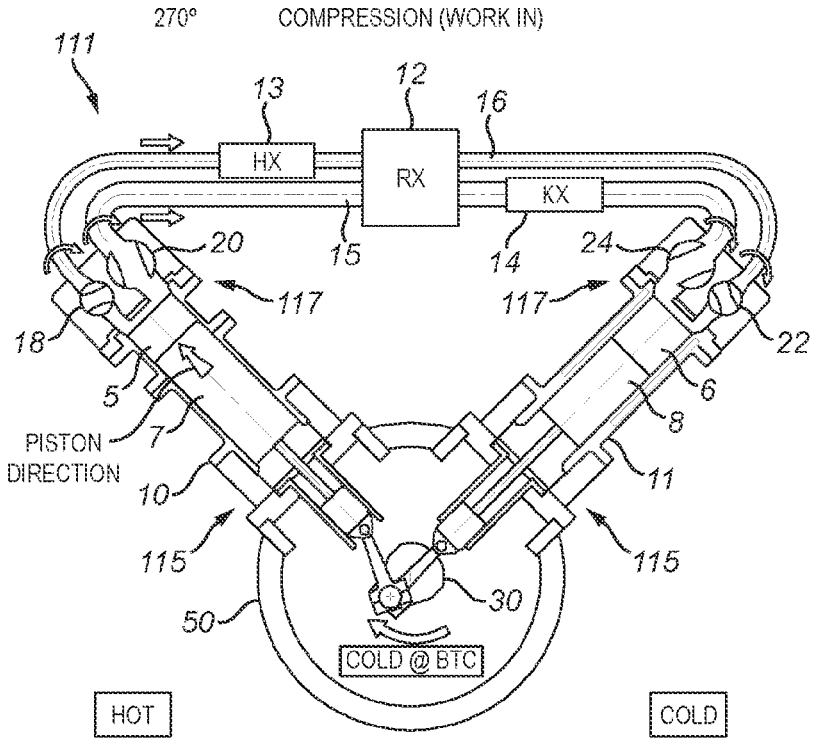
Figure 3H:
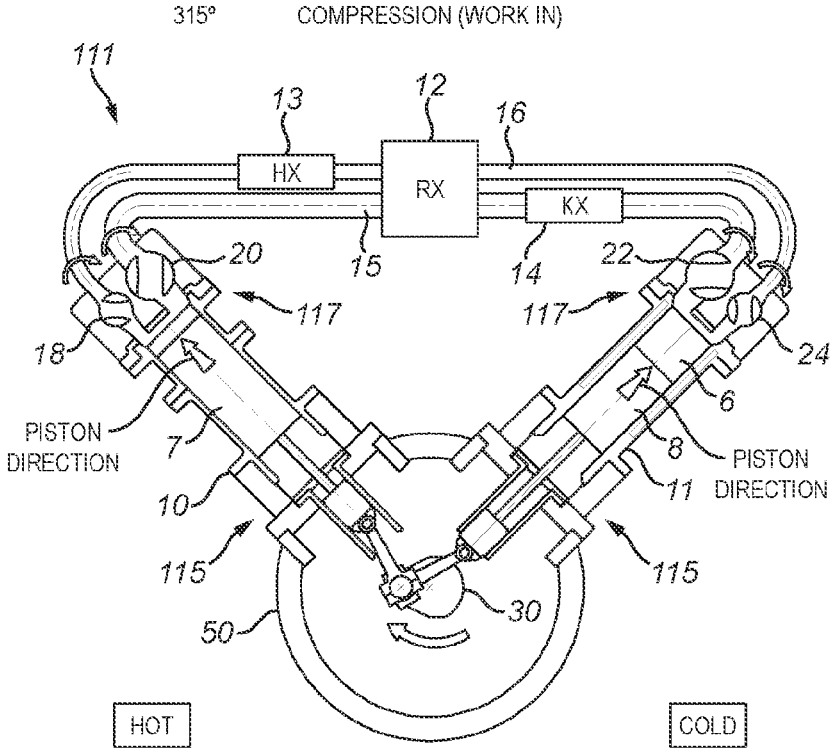

FIGS. 3*a* to 3*h* show an example of a practical implementation of the invention in the form of an "alpha" type V-configuration thermodynamic machine 111 and illustrate stages of an Ideal Pseudo-Stirling Cycle occurring in the machine 111 when operating in heat engine mode. It should be noted, however, that the present invention can equally be implemented in any thermodynamic machine of a Stirling type, including, but not limited to "alpha", "beta" and "gamma" configurations. Additionally, multiple thermodynamic machines of a Stirling type, including combinations of different configurations thermodynamic machines, may be combined to form a thermodynamic machine of the present invention. Furthermore, the thermodynamic machine of the present invention can include multiple expansion and compression chambers 5, 6. Components of the machine 111 common with the schematically illustrated machine 1 of FIG. 2*a* are indicated using common reference numerals. In this configuration, the pistons 7, 8 of the cylinders 10, 11 are connected to a common crankshaft 30 at outer ends 115 of the cylinders 10, 11, whereas the heater 13, the regenerator 12 and the cooler 14 together with the bypass conduits 15 connect inner ends 117 of the cylinders 10, 11 thereby forming a closed triangular loop. The outer ends 115 of the cylinders 10, 11 together with protruding portions of the pistons 7, 8 connected to the crankshaft 30 are housed in a crankcase 50, which may be pressurised in order to minimise leakage of the working fluid. The stages of the cycle of the machine 111 shown in FIGS. 3*a* to 3*h* are essentially the same as in the cycle of the machine 1 illustrated in FIGS. 2*a* to 2*c*. Specifically, FIGS. 3*g*, 3*h* and 3*a* correspond to the compression process 1-2 of FIGS. 2*a* to 2*c*. FIG. 3*b* corresponds to the regeneration process 2-3. FIGS. 3*c*, 3*d* and 3*e* correspond to the expansion process 3-4, and FIG. 3*f* corresponds to the regeneration process 4-1 of FIGS. 2*a* to 2*c*.

The actively actuated valves 18, 20, 22, 24 provide for a controllable actuation which simply is not possible with passive valves. Furthermore, the provision of a controllable valve at each of the heater 13, the cooler 14 and in each bypass conduit 15, 16 combined with the specific timing of the valves 18, 20, 22, 24 results in better isolation of the working fluid from the heat exchangers 13, 14 when the working fluid has to bypass the heat exchangers 13, 14. The arrangement of the valves 18, 20, 22, 24 causes the working fluid to circulate, rather than oscillate back and forth in the machine 1, 111. The continuous, rather than oscillating, flow of working fluid through the heat exchangers 13, 14 simplifies and optimises the behaviour of the working fluid. In particular, the potential for parts of the working fluid to become 'trapped' in the heat exchangers 13, 14 and the regenerator 12 due to rapid flow reversal is almost eliminated.

FIGS. 4*a* to 5*c* illustrate the Ideal Pseudo-Stirling Cycle occurring in a thermodynamic machine 1 of the present invention operating in heat pump mode. FIGS. 4*a* to 4*c* illustrate a heat pump cycle whereas Figures Sa to Sc illustrate a refrigerator mode. The phases of cycle and the timing of the valves 18, 20, 22, 24 are essentially the same in the heat pump mode and in the refrigerator mode, the difference being in the temperatures and pressures of the working fluid during expansion, compression and regeneration. Also, in the refrigerator mode, the space surrounding the heater 13 is the space to be cooled, and the space around the cooler 1 is where waste heat produced during the cycle is disposed of, whereas in the heater mode, the space around the heater 13 is used as a source of heat and the space around the cooler 14 is the space which is to be heated by the heat dispensed from the cooler 14. In order to operate in the heat pump mode, the crankshaft 30 must be rotated externally to provide mechanical work to drive the pistons 7, 8 in the cylinders 10, 11. In the heat pump mode, the heater 13 and the cooler 14 still transfer heat in the same direction as in the heat engine mode, i.e. the heater 13 conducts heat from surroundings into the expansion cylinder 10 and the cooler 14 extracts the heat from the compression cylinder 11 and dissipates in the surroundings. However, because of the mechanical input, it is possible to lower the temperature of the working fluid in the expansion cylinder 10 below the temperature of the space around the heater 13 by lowering pressure in the expansion cylinder 10 so that the heater 13 starts to draw heat from the ambient, i.e. the heater 13 is used as a cooler or refrigerator in relation to the space surrounding the heater 13. Also, the mechanical input makes it possible to raise the temperature of the working fluid in the compression cylinder 11 above room temperature by compressing the working fluid in the compression cylinder 11, so that the cooler 14 starts to eject heat into the ambient, the cooler 14 functions as a heater in relation to the space surrounding the cooler 14. In order to achieve the desired heat gradients between the ambient and the heater 13 and between the cooler 14 and the ambient in the heat pump mode, the expansion process 2-3 of FIGS. 4*a* to 5*c* begins with the temperature of the working fluid being lower than that during the compression process and the temperature of the working fluid is further lowered upon expansion in order to cool the ambient through the heater 13 and heat the ambient through the cooler 14. When the machine 1 is operated as a heater, the expansion process 2-3 begins at room temperature so that heat is rejected into the space around the compression cylinder 11 at elevated temperature. When the machine 1 is operated as a refrigerator, the compression process 1-2 begins with the working fluid being at ambient temperature so that the temperature of the working fluid can be sufficiently lowered during expansion to cool the space around the expansion cylinder 10.

The Ideal Pseudo-Stirling Cycle occurring in a thermodynamic machine 1 of the present invention operating in heat pump mode illustrated in FIGS. 4*a* to 5*c* and consists of the following processes common to both the heat pump mode of FIGS. 4*a* to 4*c* and the refrigerator mode of FIGS. 5*a* to 5*c*. During process 1 to 2, as the piston 8 is being driven by the rotation of the crankshaft 30, the working fluid is compressed in the compression cylinder 11 and is heated adiabatically. In contrast with the heat engine mode, the compression begins with the working fluid being at ambient temperature. The control mechanism times the valves 22, 24 so that during the compression stroke of the piston 8 in the compression cylinder 11 the third valve 22 is substantially open whereas the fourth valve 24 is substantially closed so that the working fluid passes through the cooler 14 before entering the regenerator 12 and bypasses the second bypass conduit 16. Since the compression is assumed to be adiabatic, the working fluid becomes heated during compression above the ambient temperature and the extra heat is dissipated into the ambient through the cooler 14. During process 2-3, more heat is extracted from the working fluid in the regenerator 12 and the extracted heat is stored in the regenerator 12 for use later in the cycle. At the same time, the first valve 18 is substantially closed and the second valve 20 is substantially open, so that upon exiting the regenerator 12, the working fluid is directed to the expansion chamber 5 substantially through the first bypass conduit 15 substantially bypassing the heater 13. During process 3-4, the rotation of the crankshaft 30 causes the piston 7 of the expansion cylinder 10 to move out in the expansion stroke. At this time, the first valve 18 is substantially open whereas the second valve 20 is substantially closed and the working fluid is directed to the expansion cylinder 10 from the regenerator 12 substantially through the heater 13, i.e. substantially bypassing the first bypass conduit 15. During the expansion stroke, the working fluid which has already cooled in the regenerator 12 is cooled still further as the pressure drops and since the temperature in the expansion chamber becomes lower than that of the external space around the heater 13, the heat from the external space is drawn through the heater 13 to the working fluid. Preferably, at the same time, the third valve 22 is substantially closed and the fourth valve 24 is substantially open. During process 4-1, i.e. during a backward stroke of the piston 7 in the expansion cylinder 10, following expansion to state 4 in the expansion cylinder 10, the first valve 18 remains substantially open whereas the second valve 20 remains substantially closed, whereby the working fluid is moved to the regenerator 12 substantially through the heater 13 substantially bypassing the first bypass conduit 15. In the regenerator 12, the working fluid is heated using the heat retained during the previous pass. At the same time, the third valve 22 remains substantially closed and the fourth valve 24 remains substantially open so that upon exiting the regenerator 12, the working fluid is directed to the compression chamber 6 substantially through the second bypass conduit 16 substantially bypassing the cooler 14. Thus, the forward stroke of the piston 8 in the compression cylinder 11 can begin at elevated temperature so as to obtain required level of heat during the subsequent compression for subsequent ejection through the cooler 14. During the outward stroke in the compression cylinder 11, the working fluid continues to receive heat from the regenerator 12. Following the outward stroke in the compression chamber 6 the working fluid has received enough heat from the regenerator 12 to reach state 1, the cycle begins again.

Although not shown in the drawings the heater 13 and the cooler 14 may be provided in the form of shell and tube exchangers. Tubes of the cooler 14 can be disposed in direct contact with a cooling medium of the cooler 14.

Although not illustrated in the drawings, the valves 18, 20, 22, 24 may be arranged to be controlled by appropriately timing the valves 18, 20, 22, 24 or by controlling flow apertures of the valves 18, 20, 22, 24 or by a combination of timing and flow aperture control, so as to regulate rotational speed of the crankshaft 30 of the machine 1, 111 and/or power output of the machine 1, 111, i.e. so that the valves 18, 20, 22, 24 act as a throttle in the machine 1, 111. The valves 18, 20, 22, 24 may be controlled to match power output of the machine 1, 111 to output load, such as, for example, an electric generator demand on the machine 1, 111. The valves 18, 20, 22, 24 may be arranged to be controlled, when required, such that less than the full volume of working fluid passes through either or both of the heat exchangers 13, 14. The valves 18, 20, 22, 24 may be controlled so that flow of the working fluid passing through the heat exchangers 13, 14 varies over time and/or so that a proportion of the working fluid flows through the respective bypass conduit 15, 16. A valve opening event may be short relative to the working fluid flow through the heat exchanger 13, 14 or the relevant valve 18, 20, 22, 24 may remain open for the full duration of the flow. A combination of the flow aperture control and the control of duration of valve opening may be used to transfer sufficient amounts of heat to or from either heat exchanger 13, 14 to match the speed of and load demand on the machine 1, 111. There may be more than one valve event per working fluid exchange event. In this case, the flow aperture can be varied in accordance with a specific pattern and frequency, e.g. pulse width modulation. The valve in the latter example may be one of the main valves 18, 20, 22, 24 or be additional to and in series or parallel to the main valves 18, 20, 22, 24. Furthermore, reduced heat transfer through either or both of the heat exchangers 13, 14 may be achieved by allowing a limited flow of the working fluid through the bypass conduits 15, 16 by limiting flow aperture of the respective valves 20, 24 in the respective bypass conduits 15, 16, while keeping the flow apertures of the valves 18, 22 of the heat exchangers 13, 14 fully open. In another variation not shown in the drawings, the valves 18, 22 in line with the heat exchangers 13, 14 can be controlled to open only for a certain proportion of the cycle time (e.g. 80%) such that the working fluid is forced along the respective bypass conduits 15, 16 for the remaining time (e.g. 20%). The valves 20, 24 in the bypass conduits 15, 16 may also be controlled such that the operation of the valves 20, 24 is sympathetic to the required flow of the working fluid through the heat exchangers 13, 14 and does not cause unnecessary flow losses.

Although not shown in the drawings, the machine 1, 111 incorporates a control circuit incorporating one or more sensors arranged within the machine 1, 111 for acquiring information on machine operating parameters. The control mechanism of the machine 1, 111 for controlling the valves 18, 20, 22, 24 is arranged in communication with the control circuit. The sensors may include, but not limited to, shaft rotational speed, linear displacement, fluid pressure, fluid temperature and machine material temperature sensors. The control mechanism may comprise an electronic computer control system. An alternative control mechanism such as a mechanical governor (not shown) may be used in particular applications.

In one embodiment, a suitable heat storage device (not shown) is provided for supplying heat to the first heat exchanger for further transfer into the expansion chamber.

The skilled person will realise that a big advantage of embodiments of the Stirling cycle machine disclosed herein is that the machine 1 is adapted to and therefore is able to seamlessly switch mode between heat pump mode and engine mode and in doing so, the rotational output of the engine mode in the form of the common output-input member 30/crankshaft 30 is in the same direction (e.g. counter-clockwise as shown in FIGS. 3 *a*) to 3*h*)) as the rotational input of the of the common output-input member 30/crankshaft 30 during the heat pump mode. Furthermore, another big advantage of embodiments of the Stirling cycle machine disclosed herein is that the machine 1 is adapted to and therefore is able to seamlessly switch mode between heat pump mode and engine mode without requiring to stop and for example reverse direction of rotation of the crankshaft 30 and/or without requiring disassembly and reassembly of the machine 1 unlike some prior art machines.

The heat storage device (not shown) is connected to the thermodynamic machine 111 by a suitable heat transfer device (not shown) configured to transfer the heat from the heat storage device to the heater 13 of the machine 111. The crankshaft 30 of the machine 111 is connected to a suitable generator (not shown) operable to convert mechanical rotation of the crank shaft 30 into electrical power and the generator (not shown) is connected to a suitable power distribution and/or a power consumption circuit or network (not shown).

Whilst specific embodiments of the present invention have been described above, it will be appreciated that modifications thereto are possible within the scope of the present invention. For example, rather than the regenerator 12 comprising a single regenerator chamber 12 as shown in the Figures (in which the volume of working fluid is a single volume such that all of the working fluid constantly commingles and is in total fluid communication), the machine 111 may comprise a multi chamber regenerator (not shown) where the multi-chambers are connected in series (not shown). Alternatively, the multi-chambers could be connected in parallel (not shown) but in that embodiment, whilst being separated into separate streams whilst in the separate parallel chambers, the working fluid would be directed to commingle both before and after the regenerator (and therefore the volume of working fluid is also a single volume such that all of the working fluid constantly commingles and is also in total fluid communication).

The invention claimed is:

1. A thermodynamic machine of a Stirling cycle type, the machine being operable as a heat engine and/or a heat pump, the machine comprising:

an expansion cylinder defining an expansion chamber, a compression cylinder defining a compression chamber and respective pistons reciprocally movable in the cylinders during operation of the machine;

a regenerator disposed between and in communication with the expansion and compression chambers, wherein the regenerator comprises a regenerator chamber and wherein the thermodynamic machine is arranged such that substantially the whole volume of a working fluid will pass through said regenerator chamber twice during a single cycle of the thermodynamic machine;

a first heat exchanger in communication with the expansion chamber and the said regenerator chamber and a second heat exchanger in communication with the compression chamber and the said regenerator chamber;

a first bypass conduit connecting the expansion chamber with the said regenerator chamber bypassing the first heat exchanger and a second bypass conduit connecting the compression chamber with the said regenerator chamber bypassing the second heat exchanger;

wherein the machine comprises at least a pair of valves;

wherein the only heat supplied to or removed from the volume of working fluid is that supplied or removed by the said first and said second heat exchangers;

one valve being provided between the expansion chamber and the first heat exchanger or between the said regenerator chamber and the first heat exchanger or in the first bypass conduit between the expansion chamber and the said regenerator chamber;

and the other valve being provided between the compression chamber and the second heat exchanger or between the said regenerator chamber and the second heat exchanger or in the second bypass conduit between the compression chamber and the said regenerator chamber; and wherein at least one of the pair of valves is capable of being controllable at least once during each cycle of the thermodynamic machine;

whereby the working fluid is isolated from the said heat exchangers when it is necessary to bypass the said heat exchangers, and the working fluid is prevented from bypassing the said heat exchangers when it is necessary for the working fluid to pass through the said heat exchangers.

2. A thermodynamic machine as claimed in claim 1, wherein the said at least one controllable valve is capable of being infinitely adjusted such that it can be controlled between any and all of the following configurations:

i) fully closed such that no working fluid can pass there-through;

ii) fully open such that working fluid can pass there-through substantially without restriction; and iii) any position between fully open and fully closed such that the valve comprises an aperture having an area through which working fluid is capable of flowing;

and wherein the area of the aperture and/or the phasing and/or timing of the movement between the positions i), ii) and/or iii) is infinitely adjustable between the fully open and fully closed positions.

3. A thermodynamic machine as claimed in claim 1, wherein the said at least one controllable valve is capable of being infinitely adjusted at any point in time in terms of phasing within the cycle of the thermodynamic machine and/or in terms of the stages of operation of the thermodynamic machine.

4. A thermodynamic machine as claimed in claim 2, wherein the said at least one controllable valve is capable of being infinitely adjusted at any point in time in terms of the duration of time in which the valve will remain in any one of configurations i), ii) or iii).

5. A thermodynamic machine as claimed in claim 1, wherein the said regenerator chamber comprises a single chamber such that substantially the whole volume of a working fluid will pass through said single regenerator chamber twice during a single cycle of the thermodynamic machine.

6. A thermodynamic machine as claimed in claim 1, wherein the said regenerator chamber comprises a single chamber such that substantially the whole volume of a working fluid will pass through said single regenerator chamber once in a first direction and once in a second, reverse, direction during a single cycle of the thermodynamic machine.

7. A thermodynamic machine as claimed in claim 1, wherein the regenerator chamber comprises two or more chambers connected in series or in parallel such that substantially the whole volume of a working fluid will pass through said two or more regenerator chambers twice during a single cycle of the thermodynamic machine.

8. A thermodynamic machine as claimed in claim 1, wherein the said regenerator chamber comprises a thermal storage medium and the said chamber is adapted to intermittently store heat from a relatively hot working fluid in said thermal storage medium as the relatively hot working fluid contacts said thermal storage medium as it passes through said regenerator chamber in a first direction.

9. A thermodynamic machine as claimed in claim 8, wherein the said regenerator chamber comprises a thermal storage medium and the said chamber is adapted to intermittently transfer heat from the said thermal storage medium to a relatively cold working fluid as the relatively cold working fluid contacts said thermal storage medium as it passes through said regenerator chamber in a second, reverse, direction.

10. A thermodynamic machine as claimed in claim 1, wherein the machine further comprises a control mechanism configured to time the opening and closing and any position there-between of the or each valves.

11. A thermodynamic machine as claimed in claim 10, wherein the control mechanism is adapted to adjust in real time the timing of the or each valves in accordance with actual operating conditions.

12. A thermodynamic machine as claimed in claim 10, wherein the control mechanism comprises an electronic control module.

13. A thermodynamic machine as claimed in claim 10, wherein both valves are controllable and the control mechanism is adapted to control flow through the valves over time so as to direct working fluid of the machine between the said regenerator chamber and the expansion and compression chambers either substantially through the respective bypass conduit or substantially through the respective heat exchanger at pre-determined stages of the machine cycle.

14. A thermodynamic machine as claimed in claim 10, wherein the valves are actively actuated valves.

15. A thermodynamic machine as claimed in claim 10, wherein the machine is operable in each of a heat engine mode, in which thermal input is converted into mechanical work or a heat pump mode, in which mechanical work is converted into thermal output, wherein in the heat pump mode, the machine is operable to provide a positive thermal output, whereby the machine operates as a heater, or a negative thermal output, whereby the machine operates as a cooler or refrigerator, wherein the control mechanism is configured to time the or each valve accordingly in the or each of the heat engine mode and the heat pump mode.

16. A thermodynamic machine as claimed in claim 15, wherein one valve is provided between the expansion chamber and the said regenerator chamber at the first heat exchanger and the other valve is provided between the compression chamber and the said regenerator chamber at the second heat exchanger.

17. A thermodynamic machine as claimed in claim 16, wherein in the heat engine mode, the control mechanism is configured to control the valves so that during a compression stroke of the piston in the compression cylinder the valve at the second heat exchanger is substantially closed whereby the working fluid is directed to the said regenerator chamber substantially through the second bypass conduit substantially bypassing the second heat exchanger; and so that during a backward stroke of the piston in the expansion cylinder, the valve at the first heat exchanger is substantially closed whereby the working fluid is directed to the said regenerator chamber substantially through the first bypass conduit substantially bypassing the first heat exchanger.

18. A thermodynamic machine as claimed in claim 16, wherein in the heat pump mode, the control mechanism is configured to control the valves so that during a compression stroke of the piston in the compression cylinder, the valve at the second heat exchanger is substantially open whereas the valve at the first heat exchanger is substantially closed, whereby the working fluid is directed to the said regenerator chamber through the second heat exchanger thereby rejecting heat gained during compression via the second heat exchanger; and so that during an expansion stroke of the piston in the expansion cylinder, the valve at the first heat exchanger is substantially open whereas the valve at the second heat exchanger is substantially closed, whereby heat is transferred from surroundings of the first heat exchanger into the expansion chamber.

19. A thermodynamic machine as claimed in claim 15, wherein the machine comprises four valves wherein:

a first valve is provided between the expansion chamber and the first heat exchanger or between the first heat exchanger and the said regenerator chamber and a second valve is provided in the first bypass conduit between the expansion chamber and the said regenerator chamber;

a third valve is provided between the compression chamber and the second heat exchanger or between the second heat exchanger and the said regenerator chamber and a fourth valve is provided in the second bypass conduit between the compression chamber and the said regenerator chamber; and wherein at least one of the first, second, third and fourth valves is controllable.

20. A thermodynamic machine as claimed in claim 19, wherein in the heat engine mode, the control mechanism is configured to time valves so that during a compression stroke of the piston in the compression cylinder the third valve is substantially closed whereas the fourth valve is substantially open whereby the working fluid is directed to the said regenerator chamber substantially through the second bypass conduit substantially bypassing the second heat exchanger, wherein at the same time, the first valve is substantially open and the second valve is substantially closed, whereby upon exiting the said regenerator chamber, the working fluid is directed to the expansion chamber substantially through the first heat exchanger, substantially bypassing the first bypass conduit.

21. A thermodynamic machine as claimed in claim 19, wherein, in the heat engine mode, the control mechanism is configured to time the valves so that during a backward stroke of the piston in the expansion cylinder, the first valve is substantially closed whereas the second valve is substantially open, whereby the working fluid is directed to the said regenerator chamber substantially through the first bypass conduit substantially bypassing the first heat exchanger, wherein at the same time, the third valve is substantially open and the fourth valve is substantially closed, whereby upon exiting the said regenerator chamber, the working fluid is directed to the compression chamber substantially through the second heat exchanger, substantially bypassing the second bypass conduit.

22. A thermodynamic machine as claimed in claim 19, wherein, in the heat pump mode of the machine, the control mechanism is configured to time the valves so that during a compression stroke of the piston in the compression cylinder the third valve is substantially open whereas the fourth valve is substantially closed whereby the working fluid is directed to the said regenerator chamber substantially through the second heat exchanger, substantially bypassing the second bypass conduit, wherein, at the same time, the first valve is substantially closed and the second valve is substantially open, whereby upon exiting the said regenerator chamber, the working fluid is directed to the expansion chamber substantially through the first bypass conduit substantially bypassing the first heat exchanger.

23. A thermodynamic machine as claimed in claim 19, wherein in the heat pump mode of the machine, the control mechanism is configured to time the valves so that during the expansion stroke in the expansion cylinder, the first valve is substantially open whereas the second valve is substantially closed, whereby the working fluid is directed to the expansion cylinder from the said regenerator chamber substantially through the first heat exchanger, substantially bypassing the first bypass conduit, wherein at the same time, the third valve is substantially closed and the fourth valve is substantially open.

24. A thermodynamic machine as claimed in claim 19, wherein, in the heat pump mode of the machine, the control mechanism is configured to time the valves so that during a backward stroke of the piston in the expansion cylinder the first valve remains substantially open whereas the second valve remains substantially closed, whereby the working fluid is directed to the said regenerator chamber substantially through the first heat exchanger substantially bypassing the first bypass conduit, wherein, at the same time, the third valve remains substantially closed and the fourth valve remains substantially open whereby upon exiting the said regenerator chamber, the working fluid is directed to the compression chamber substantially through the second bypass conduit substantially bypassing the second heat exchanger, whereby an outward stroke in the compression cylinder begins at elevated temperature so as to obtain the required level of heat during the subsequent compression for subsequent ejection through the second heat exchanger.

25. A thermodynamic machine as claimed in claim 1, wherein more than one valve is provided along one or each of four working fluid paths, these being a) between the said regenerator chamber and the expansion chamber through the first heat exchanger, b) between the expansion chamber and the said regenerator chamber via the first bypass conduit, c) between the said regenerator chamber and the compression chamber through the second heat exchanger and d) between the compression chamber and the said regenerator chamber via the second bypass conduit, the or each additional valve being controllable.

26. A thermodynamic machine as claimed in claim 1, wherein the machine is adapted to seamlessly switch mode between heat pump mode and engine mode and wherein the rotational output of the engine mode is in the same direction as the rotational input of the heat pump mode.

27. A thermodynamic machine as claimed in claim 26, wherein the machine is able to seamlessly switch mode between heat pump mode and engine mode without requiring to stop and/or without requiring disassembly and reassembly.

28. A thermodynamic machine as claimed in claim 1, wherein the or each valves are arranged to be controlled, when required, such that less than the full volume of working fluid passes through either or both of the heat exchangers and/or flow of the working fluid passing through the heat exchangers varies over time and/or so that a proportion of the working fluid flows through the respective bypass conduit, thereby permitting partial bypass of working fluid with respect to the heat exchangers.

29. A thermodynamic machine as claimed in claim 1, wherein the machine incorporates a control circuit incorporating one or more sensors arranged within the machine for acquiring information on machine operating parameters and the control mechanism for controlling the or each valves is arranged in communication with the control circuit.

30. A method of operating a thermodynamic machine as an engine and/or as a heat pump of a Stirling cycle type, the method comprising the steps of:

a) providing a thermodynamic machine operable as a heat engine and a heat pump, the thermodynamic machine comprising:

an expansion cylinder defining an expansion chamber, a compression cylinder defining a compression chamber and respective pistons reciprocally movable in the chambers during operation of the machine;

a regenerator disposed between and in communication with the expansion and compression chambers, wherein the regenerator comprises a regenerator chamber and wherein the thermodynamic machine is arranged such that substantially the whole volume of a working fluid will pass through said regenerator chamber twice during a single cycle of the thermodynamic machine;

a first heat exchanger in communication with the expansion chamber and the said regenerator chamber and a second heat exchanger in communication with the compression chamber and the said regenerator chamber;

a first bypass conduit connecting the expansion chamber with the said regenerator chamber bypassing the first heat exchanger and a second bypass conduit connecting the compression chamber with the said regenerator chamber bypassing the second heat exchanger;

wherein the only heat supplied to or removed from the volume of working fluid is that supplied or removed by the said first and said second heat exchangers;

wherein the machine comprises at least a pair of valves;

one valve being provided between the expansion chamber and the first heat exchanger or between the first heat exchanger and the said regenerator chamber or in the first bypass conduit between the expansion chamber and the said regenerator chamber;

and the other valve being provided between the compression chamber and the second heat exchanger or between the second heat exchanger and the said regenerator chamber or in the second bypass conduit between the compression chamber and the said regenerator chamber; and b) timing at least one of the valves such that flow of working fluid is controlled through the or each valve over time at least once during each cycle of the thermodynamic machine, so as to direct working fluid of the machine between the said regenerator chamber and the expansion and compression chambers either substantially through the respective bypass conduit or substantially through the respective heat exchanger at pre-determined stages of the machine cycle;

whereby the working fluid is isolated from the said heat exchangers when it is necessary to bypass the said heat exchangers, and the working fluid is prevented from bypassing the said heat exchangers when it is necessary for the working fluid to pass through the said heat exchangers.

31. A method as claimed in claim 30, wherein the method further comprises the step of actively actuating the or each valve applying an external force to open or close the or each valve.

32. A method as claimed in claim 30, wherein the method comprises the step of adjusting in real time the timing of the or each valve in accordance with actual operating conditions.

33. A method as claimed in claim 30, wherein the method comprises the step of operating the machine in each of a heat engine mode in which thermal input is converted into mechanical work or a heat pump mode in which mechanical work is converted into thermal output, which may be positive or negative thermal output; and timing the or each valve accordingly in the heat engine mode or the heat pump mode.

34. A method as claimed in claim 33, wherein the method comprises providing one valve between the expansion chamber and the said regenerator chamber at the first heat exchanger and providing the other valve between the compression chamber and the said regenerator chamber at the second heat exchanger.

35. A method as claimed in claim 34, wherein, the step of timing the valves in the heat engine mode comprises:

substantially closing the valve at the second heat exchanger during a compression stroke of the piston in the compression cylinder so as to direct the working fluid to the said regenerator chamber substantially through the second bypass conduit substantially bypassing the second heat exchanger; and substantially closing the valve at the first heat exchanger during a backward stroke of the piston in the expansion cylinder, so as to direct the working fluid to the said regenerator chamber substantially through the first bypass conduit substantially bypassing the first heat exchanger.

36. A method as claimed in claim 34, wherein the step of timing the valves in the heat pump mode comprises:

substantially opening the valve at the second heat exchanger during a compression stroke of the piston in the compression cylinder;

substantially closing the valve at the first heat exchanger so as to direct the working fluid to the said regenerator chamber through the second heat exchanger thereby rejecting heat gained during compression via the second heat exchanger; and substantially opening the valve at the first heat exchanger during an expansion stroke of the piston in the expansion cylinder and substantially closing the valve at the second heat exchanger so as to cause heat to be transferred from surroundings of the first heat exchanger into the expansion chamber.

37. A method as claimed in claim 33, wherein the method comprises the step of providing the machine with four valves wherein:

a first valve is provided between the expansion chamber and the first heat exchanger or between the first heat exchanger and the said regenerator chamber and a second valve is provided in the first bypass conduit between the expansion chamber and the said regenerator chamber;

a third valve is provided between the compression chamber and the second heat exchanger or between the second heat exchanger and the said regenerator chamber and a fourth valve is provided in the second bypass conduit between the compression chamber and the said regenerator chamber; and wherein at least one of the first, second, third and fourth valves is controllable.

38. A method as claimed in claim 37, wherein the step of timing the valves in the heat engine mode comprises:

substantially closing the third valve and substantially opening the fourth valve during a compression stroke of the piston in the compression cylinder so as to direct the working fluid to the said regenerator chamber substantially through the second bypass conduit substantially bypassing the second heat exchanger; and substantially opening the first valve and substantially closing the second valve, so that upon exiting the said regenerator chamber, the working fluid is directed to the expansion chamber substantially through the first heat exchanger, substantially bypassing the first bypass conduit, whereby the working fluid becomes further heated to provide the working fluid with sufficient energy to effect an expansion stroke in the expansion cylinder.

39. A method as claimed in claim 37, wherein the step of timing the valves in the heat engine mode comprises:

substantially closing the first valve and substantially opening the second valve during a backward stroke of the piston in the expansion cylinder so as to direct the working fluid to the said regenerator chamber substantially through the first bypass conduit substantially bypassing the first heat exchanger; and concurrently substantially opening the third valve and substantially closing the fourth valve, whereby upon exiting the said regenerator chamber, the working fluid is directed to the compression chamber substantially through the second heat exchanger, substantially bypassing the second bypass conduit, whereby as the working fluid is further cooled as it passes through the second heat exchanger, the working fluid still has enough energy to move the piston in the compression cylinder but is cooled sufficiently to reduce the work required to subsequently compress the working fluid in the compression.

40. A method as claimed in claim 37, wherein in the heat pump mode the method comprises the steps of:

starting expansion with the temperature of the working fluid being lower than that during compression, whereby the temperature of the working fluid is further lowered upon expansion;

substantially opening the third valve and substantially closing the fourth valve during a compression stroke of the piston in the compression cylinder whereby the working fluid is directed to the said regenerator chamber substantially through the second heat exchanger, substantially bypassing the second bypass conduit, whereby heat gained by the working fluid during compression is dissipated into the ambient through the second heat exchanger; and concurrently substantially closing the first valve and substantially opening the second valve, whereby upon exiting the said regenerator chamber, the working fluid is directed to the expansion chamber substantially through the first bypass conduit substantially bypassing the first heat exchanger.

41. A method as claimed in claim 37, wherein the step of timing the valves in the heat pump mode of the machine comprises:

substantially opening the first valve and substantially closing the second valve during the expansion stroke in the expansion cylinder, whereby the working fluid is directed to the expansion cylinder from the said regenerator chamber substantially through the first heat exchanger, substantially bypassing the first bypass conduit, whereby, as the pressure drops during the expansion stroke, the working fluid which has already cooled in the said regenerator chamber is cooled still further; and concurrently substantially closing the third valve and substantially opening the fourth valve.

42. A method as claimed in claim 37, wherein the step of timing the valves in the heat pump mode of the machine comprises:

keeping the first valve substantially open and the second valve substantially closed during a backward stroke of the piston in the expansion cylinder, whereby the working fluid is directed to the said regenerator chamber substantially through the first heat exchanger substantially bypassing the first bypass conduit, whereby the working fluid is moved to the said regenerator chamber and becomes heated in the said regenerator chamber using the heat retained during the previous pass; and concurrently keeping the third valve substantially closed and the fourth valve substantially open whereby upon exiting the said regenerator chamber, the working fluid is directed to the compression chamber substantially through the second bypass conduit substantially bypassing the second heat exchanger, whereby a forward stroke in the compression cylinder begins at elevated temperature so as to obtain the required level of heat during the subsequent compression for subsequent ejection through the second heat exchanger.

43. A method as claimed in claim 30, wherein the said at least one controllable valve is capable of being infinitely adjusted such that it is controlled between any and all of the following configurations:

i) fully closed such that no working fluid can pass there-through;

ii) fully open such that working fluid can pass there-through substantially without restriction; and iii) any position between fully open and fully closed such that:

the valve comprises an aperture having an area through which working fluid is capable of flowing;

and wherein the area of the aperture and/or the phasing and/or timing of the movement between the positions i), ii) and/or iii) is infinitely adjustable between the fully open and fully closed positions.

44. A method as claimed in claim 30, wherein the said at least one controllable valve is capable of being infinitely adjusted at any point in time in terms of phasing within the cycle of the thermodynamic machine and/or in terms of the stages of operation of the thermodynamic machine.

45. A method as claimed in claim 43, wherein the said at least one controllable valve is capable of being infinitely adjusted at any point in time in terms of the duration of time in which the valve will remain in any one of configurations i), ii) or iii).

46. A method as claimed in claim 30, wherein the said regenerator chamber comprises a single chamber such that substantially the whole volume of a working fluid will pass through said single regenerator chamber twice during a single cycle of the thermodynamic machine.

47. A method as claimed in claim 30, wherein the said regenerator chamber comprises a single chamber such that substantially the whole volume of a working fluid will pass through said single regenerator chamber once in a first direction and once in a second, reverse, direction during a single cycle of the thermodynamic machine.

48. A method as claimed in claim 30, wherein the regenerator chamber comprises two or more chambers connected in series such that substantially the whole volume of a working fluid will pass through said two or more regenerator chambers twice during a single cycle of the thermodynamic machine.

49. A method as claimed in claim 30, wherein the said regenerator chamber comprises a thermal storage medium and the said chamber is adapted to intermittently store heat from a relatively hot working fluid in said thermal storage medium as the relatively hot working fluid contacts said thermal storage medium as it passes through said regenerator chamber in a first direction.

50. A method as claimed in claim 49, wherein the said regenerator chamber comprises a thermal storage medium and the said chamber is adapted to intermittently transfer heat from the said thermal storage medium to a relatively cold working fluid as the relatively cold working fluid contacts said thermal storage medium as it passes through said regenerator chamber in a second, reverse, direction.

* * * * *

UNITED STATES PATENT AND TRADEMARK OFFICE

CERTIFICATE OF CORRECTION

PATENT NO. : 9,494,107 B2
APPLICATION NO. : 14/772490
DATED : November 15, 2016
INVENTOR(S) : Whittaker et al.

It is certified that error appears in the above-identified patent and that said Letters Patent is hereby corrected as shown below:

On the Title Page

Item (73), Assignee, change "Foster Findlay Associates Limited" to --Whittaker Engineering (Stonehaven) Limited--

Signed and Sealed this
First Day of August, 2017

Joseph Matal

Joseph Matal
*Performing the Functions and Duties of the*
*Under Secretary of Commerce for Intellectual Property and*
*Director of the United States Patent and Trademark Office*